US008079890B2

(12) United States Patent
Seligman

(10) Patent No.: US 8,079,890 B2
(45) Date of Patent: Dec. 20, 2011

(54) BUILDING BLOCK TOY SET

(75) Inventor: Scott P. Seligman, San Marcos, CA (US)

(73) Assignee: JSN, Inc., San Marcos, CA (US)

( * ) Notice: Subject to any disclaimer, the term of this patent is extended or adjusted under 35 U.S.C. 154(b) by 968 days.

(21) Appl. No.: 12/037,777

(22) Filed: Feb. 26, 2008

(65) Prior Publication Data

US 2009/0215357 A1 Aug. 27, 2009

(51) Int. Cl.
*A63H 33/12* (2006.01)
*A63H 33/04* (2006.01)

(52) U.S. Cl. ..... 446/124; 446/91; 446/118

(58) Field of Classification Search ..... 446/91, 446/484, 85, 118, 124; 434/113, 156, 176
See application file for complete search history.

(56) References Cited

U.S. PATENT DOCUMENTS

| | | | |
|---|---|---|---|
| 3,553,438 | A | 1/1971 | Blitz et al. |
| 3,748,748 | A | 7/1973 | Bevan et al. |
| 4,348,191 | A | 9/1982 | Lipsitz et al. |
| 4,729,564 | A | 3/1988 | Kuna et al. |
| 4,820,233 | A | 4/1989 | Weiner |
| 4,869,701 | A | 9/1989 | Kawai et al. |
| 4,936,780 | A | 6/1990 | Cogliano |
| 4,968,255 | A | 11/1990 | Lee et al. |
| 5,013,276 | A | 5/1991 | Garfinkel |
| 5,188,533 | A | 2/1993 | Wood |
| 5,190,287 | A | 3/1993 | Ishiyama |
| 5,314,336 | A | 5/1994 | Diamond et al. |
| 5,451,178 | A | 9/1995 | Yorozu et al. |
| 5,607,336 | A | 3/1997 | Lebensfeld et al. |
| 6,110,000 | A | 8/2000 | Ting |
| 6,171,168 | B1 | 1/2001 | Jessop |
| 6,227,931 | B1 | 5/2001 | Shackelford |
| 6,290,565 | B1 | 9/2001 | Galyean et al. |
| 6,380,844 | B2 | 4/2002 | Pelekis |
| 6,443,796 | B1 | 9/2002 | Shackelford |
| 6,585,553 | B1 * | 7/2003 | Fetridge et al. ..... 446/91 |
| 6,679,751 | B1 | 1/2004 | Maxwell et al. |
| 6,719,603 | B2 | 4/2004 | Chan |
| 7,238,026 | B2 | 7/2007 | Brown et al. |
| 2002/0058235 | A1 | 5/2002 | Dinnerstein |

(Continued)

FOREIGN PATENT DOCUMENTS

| | | |
|---|---|---|
| JP | 11-114026 | 4/1999 |

*Primary Examiner* — Dmitry Suhol
*Assistant Examiner* — Alex F. R. P. Rada, II
(74) *Attorney, Agent, or Firm* — Procopio Cory Hargreaves & Savitch LLP

(57) ABSTRACT

A building block toy set has first and second blocks each having a first connection device at the upper end and a second connection device at the lower end which is releasably mateable with the first connection device on the other block, whereby the first block is connectable on top of the second block in a first configuration and the second block is connectable on top of the first block in a second configuration. Each first connection device has an actuator formation on the first connection device and at least the second block is a smart block having a sensor assembly associated with the second connection device which is activated by the actuator formation when the second block is interconnected with the first block in the second configuration. A processing unit is mounted in the smart block and associated with the sensor assembly to produce a sensory output signal when the sensor assembly is activated.

27 Claims, 31 Drawing Sheets

U.S. PATENT DOCUMENTS

| | | | | |
|---|---|---|---|---|
| 2002/0061701 | A1 | 5/2002 | Chan | |
| 2002/0196250 | A1* | 12/2002 | Anderson et al. | 345/420 |
| 2003/0139113 | A1 | 7/2003 | Wood et al. | |
| 2003/0162160 | A1 | 8/2003 | Horchler et al. | |
| 2004/0185745 | A1* | 9/2004 | Reining et al. | 446/91 |
| 2005/0064372 | A1 | 3/2005 | Shuler et al. | |
| 2007/0184722 | A1* | 8/2007 | Doherty | 439/638 |
| 2008/0166926 | A1* | 7/2008 | Seymour et al. | 439/701 |
| 2008/0220690 | A1* | 9/2008 | Munch | 446/128 |
| 2009/0305602 | A1* | 12/2009 | Gaute | 446/91 |

* cited by examiner

| IF | AND | AND | AND | AND | AND | AND | AND | AND | AND | AND | AND | AND | AND |
|---|---|---|---|---|---|---|---|---|---|---|---|---|---|
| | | B C D | A B C D | C D | D | A D | A C D | A B D | A B C | A C | B C | A B | C |
| | THEN | THEN | THEN | THEN | THEN | THEN | THEN | THEN | THEN | THEN | THEN | THEN | THEN |
| E F G | 1+0=1 | 1+1=2 | 1+2=3 | 1+3=4 | 1+4=5 | 1+5=6 | 1+6=7 | 1+7=8 | 1+8=9 | 1+9=10 | 1+10=11 | 1+11=12 | 1+12=13 |
| E F G H | 2+0=2 | 2+1=3 | 2+2=4 | 2+3=5 | 2+4=6 | 2+5=7 | 2+6=8 | 2+7=9 | 2+8=10 | 2+9=11 | 2+10=12 | 2+11=13 | 2+12=14 |
| E F | 3+0=3 | 3+1=4 | 3+2=5 | 3+3=6 | 3+4=7 | 3+5=8 | 3+6=9 | 3+7=10 | 3+8=11 | 3+9=12 | 3+10=13 | 3+11=14 | 3+12=15 |
| E | 4+0=4 | 4+1=5 | 4+2=6 | 4+3=7 | 4+4=8 | 4+5=9 | 4+6=10 | 4+7=11 | 4+8=12 | 4+9=13 | 4+10=14 | 4+11=15 | 4+12=16 |
| E H | 5+0=5 | 5+1=6 | 5+2=7 | 5+3=8 | 5+4=9 | 5+5=10 | 5+6=11 | 5+7=12 | 5+8=13 | 5+9=14 | 5+10=15 | 5+11=16 | 5+12=17 |
| E F H | 6+0=6 | 6+1=7 | 6+2=8 | 6+3=9 | 6+4=10 | 6+5=11 | 6+6=12 | 6+7=13 | 6+8=14 | 6+9=15 | 6+10=16 | 6+11=17 | 6+12=18 |
| E G H | 7+0=7 | 7+1=8 | 7+2=9 | 7+3=10 | 7+4=11 | 7+5=12 | 7+6=13 | 7+7=14 | 7+8=15 | 7+9=16 | 7+10=17 | 7+11=18 | 7+12=19 |
| F G H | 8+0=8 | 8+1=9 | 8+2=10 | 8+3=11 | 8+4=12 | 8+5=13 | 8+6=14 | 8+7=15 | 8+8=16 | 8+9=17 | 8+10=18 | 8+11=19 | 8+12=20 |
| F H | 9+0=9 | 9+1=10 | 9+2=11 | 9+3=12 | 9+4=13 | 9+5=14 | 9+6=15 | 9+7=16 | 9+8=17 | 9+9=18 | 9+10=19 | 9+11=20 | 9+12=21 |
| F G | 10+0=10 | 10+1=11 | 10+2=12 | 10+3=13 | 10+4=14 | 10+5=15 | 10+6=16 | 10+7=17 | 10+8=18 | 10+9=19 | 10+10=20 | 10+11=21 | 10+12=22 |
| G H | 11+0=11 | 11+1=12 | 11+2=13 | 11+3=14 | 11+4=15 | 11+5=16 | 11+6=17 | 11+7=18 | 11+8=19 | 11+9=20 | 11+10=21 | 11+11=22 | 11+12=23 |
| F | 12+0=12 | 12+1=13 | 12+2=14 | 12+3=15 | 12+4=16 | 12+5=17 | 12+6=18 | 12+7=19 | 12+8=20 | 12+9=21 | 12+10=22 | 12+11=23 | 12+12=24 |

FIG 18

BUILDING BLOCK TOY SET

BACKGROUND

1. Field of the Invention

The present invention relates generally to building block toys and is particularly concerned with a building block toy set which provides audible feedback based on characteristics of the blocks in the set.

2. Related Art

There are many types of building block toy sets, such as Lego®, and building blocks are one of the most popular toys for toddlers. Building blocks can be used anywhere and provide hours of creative fun through building. Some building blocks are simple cubes designed for stacking, while others are releasably fastened together by an interlocking mechanism, such as Lego® blocks.

There are also many types of educational electronic talking toys which help toddlers learn colors, numbers, shapes, and the like. Some of these toys are stand alone units such as a talking bear; other types consist of a base unit and a number of additional objects which the base unit identifies when the object is placed in it. Some examples of the latter type of toy are U.S. Pat. No. 7,238,026 of Brown et al. and U.S. Pat. No. 5,190,287 of Ishiyama. One problem with some electronic talking toys is lack of creativity, such that they do not tend to capture a child's attention for extended periods of time.

Some building block toys are also designed to produce an audible output or "talk" to a child as the child plays with the blocks. For example, U.S. Pat. No. 4,936,780 of Cogliano describes alphabet blocks which produce a sound output when a face of the block is touched. U.S. Pat. No. 6,679,751 of Maxwell describes blocks tethered together with an interlocking mechanism including actuator switches which produce an audible or visual output when two blocks are connected together in a particular orientation. The output may be music or any other entertaining sound.

SUMMARY

According to one aspect, a building block toy set is provided, which comprises at least first and second blocks each having first and second opposite ends, each block having a first connection device at the first end and a second connection device at the second end which is releasably mateable with the first connection device on the other block, at least the first block having an actuator on the first connection device and at least the second block comprising a smart block having a sensor assembly associated with the second connection device which is activated by the actuator when the second block is interconnected with the first block, and a processing unit associated with the sensor assembly which produces a sensory output when the sensor assembly is activated. The sensory output may be an audible output signal, a visual output signal, or a combination of audible and visual output signals. In one embodiment, the sensory output is produced when the second or smart block is stacked on top of the first block.

Since each block in the set has first and second connection devices at opposite ends, they can be connected either with the first block on top of the second block or the second block on top of the first block, and additional blocks can be connected on top of the uppermost block. In one embodiment, both blocks are smart blocks and a different sensory output is produced depending on whether the first block is stacked on top of the second block or the second block is stacked on top of the first block. A plurality of smart blocks may be provided with different characteristics and different sensory outputs when stacked on top of other blocks. In one embodiment, each smart block is of a different color and the sensory output is an audible output which identifies the color of the block when it is stacked or interconnected with another block.

In one embodiment, a plurality of different first blocks are provided which have different actuators on the first connection device and the sensor assembly on the second block can distinguish between the different actuators. The processing unit on the smart block produces a different sensory output depending either on a characteristic of the smart block or on the actuator which is detected by the sensor assembly. The smart block itself has an actuator on the first connection device which is the same as the actuator on one of the first blocks. A plurality of different smart blocks may be provided which produce different sensory outputs when attached to other blocks, and a smart block may be attached to one or more other blocks simultaneously.

The different smart blocks in a building block kit according to one embodiment may have processing units which carry out different mathematical functions, such as addition, subtraction, multiplication, and division, and produce audible outputs indicating the result of the mathematical function. These smart blocks may each have outer indicia representing the function to be performed, such as a plus sign, a minus sign, a multiplication sign, and a division sign. Each smart block has a second connection device which can be connected to at least two first connection devices on different blocks simultaneously. A plurality of first blocks which comprise number blocks are provided, corresponding to numbers one, two, three, and so on, with the different number blocks having different sizes, shapes, or indicia to represent the different numbers. The first blocks may be non-smart blocks containing no electronics. The actuator on each number block is different from the actuator on different number blocks, and the sensor assembly on the smart block is arranged to distinguish between the different actuators, so that if an addition smart block is attached to a number one block and a number two block, it produces an audible output stating "One plus two equals three". The number two block may be twice the size of a number one block, the number three block may be three times the size of the number block, and so on, in order to provide a further visual indication of the difference in number.

Some smart blocks in one embodiment may be fun blocks designed to provide an audible output, a visual output, or both. The output may be based on visual characteristics of the blocks themselves, and each fun block may have a plurality of different possible outputs, with a different output being selected whenever the fun block is attached to another block. The visual characteristics may be color, as noted above, or may be other characteristics such as images on the blocks or the shape of the block. In one embodiment, color or other fun blocks may be part of a set including the math and number blocks, and may be attachable to the math smart blocks or to any of the number blocks of a math kit. In this case, the fun smart blocks and some non-smart blocks may be purchased when a child is relatively young, followed by the math smart blocks as an add-on kit as the child gets older. Each smart block may be of the same size as a selected number block, such as a number two block, and have the same second connection device as all the other smart blocks, but has a modified processing unit based on the desired audible output.

According to another aspect, a building block toy set comprises at least one smart block having two identical first connection devices, first and second sensor devices associated with the respective connection devices, and a processing unit connected to the sensor devices which has a processing module which detects actuation of one or more sensor devices, and a sensory output module which produces a sensory output signal when one or both sensor devices are actuated. The set also includes at least two standard blocks which each have a second connector device releasably connectable to either of the first connection devices of the smart block. Each second connector device has an actuator which actuates a sensor device when the second connector device is connected to the first connector device associated with the sensor device. The smart block can be connected to either one of the standard blocks, or to both standard blocks simultaneously, using both first connection devices. The sensory output module produces an output signal when either of the sensor devices is actuated and when both sensor devices are actuated. The output signal may be generated randomly or sequentially, or may be selected depending on the detected actuator, with different standard blocks having different actuator formations.

The building block toy allows a child to play with a few blocks or many blocks with a sensory output feature of talking, sounds, or visual outputs stimulating learning while the child is absorbed in the creative aspects of building.

BRIEF DESCRIPTION OF THE DRAWINGS

The details of the present invention, both as to its structure and operation, may be gleaned in part by study of the accompanying drawings, in which like reference numerals refer to like parts, and in which:

FIG. 18 is a table illustrating the different outputs produced by the control circuit of FIG. 17 when an addition smart block is attached to different combinations of the blocks of FIGS. 13A to 13L.

DETAILED DESCRIPTION

Certain embodiments as disclosed herein provide for a toy building block set which has a plurality of blocks which can be assembled by a child, at least some of the blocks producing a sensory output such as an audible or visual output when attached to a second block.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
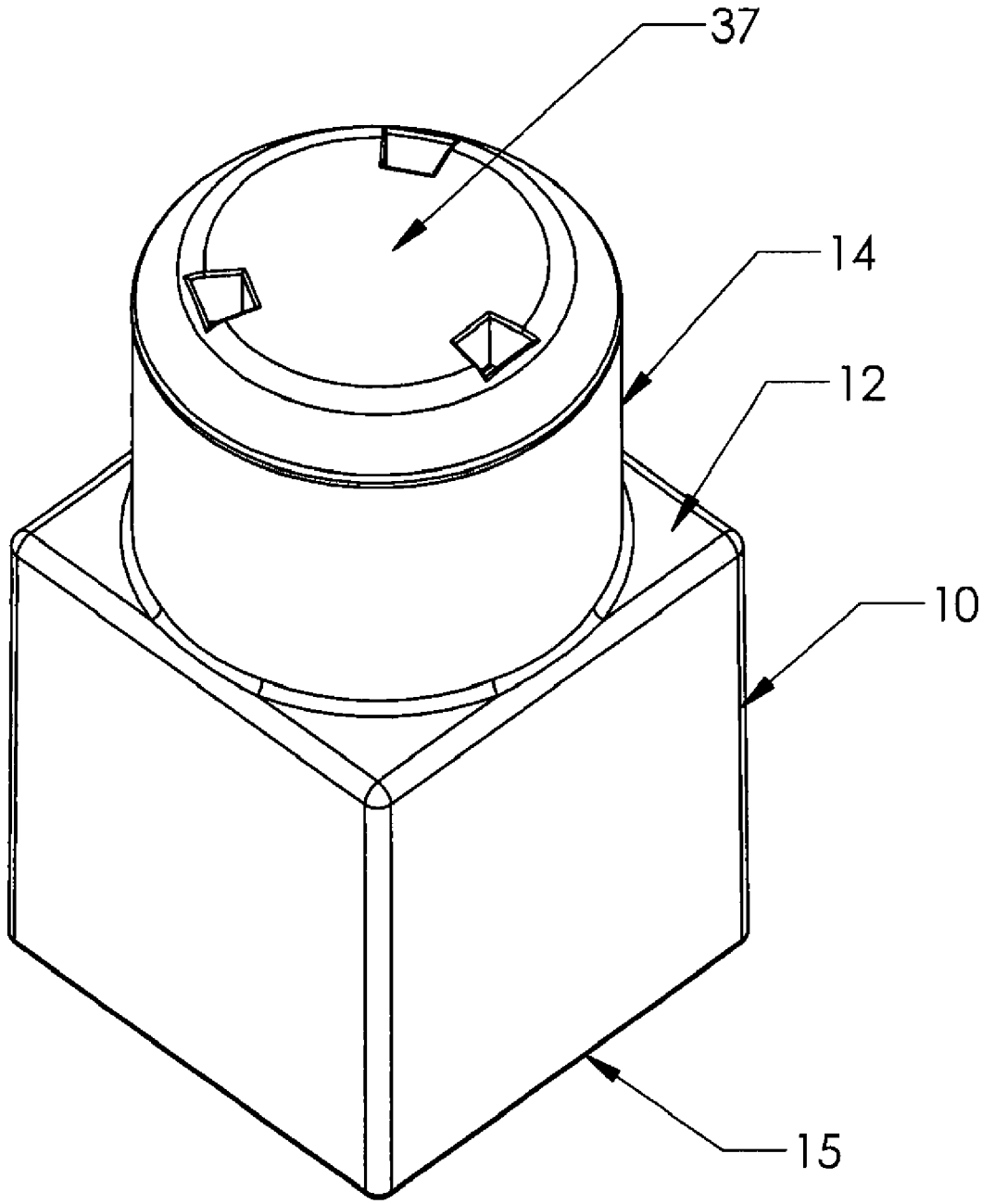
FIG. 1 is a perspective view of a one post building block forming part of a toy building block set according to a first embodiment.
Figure 2:
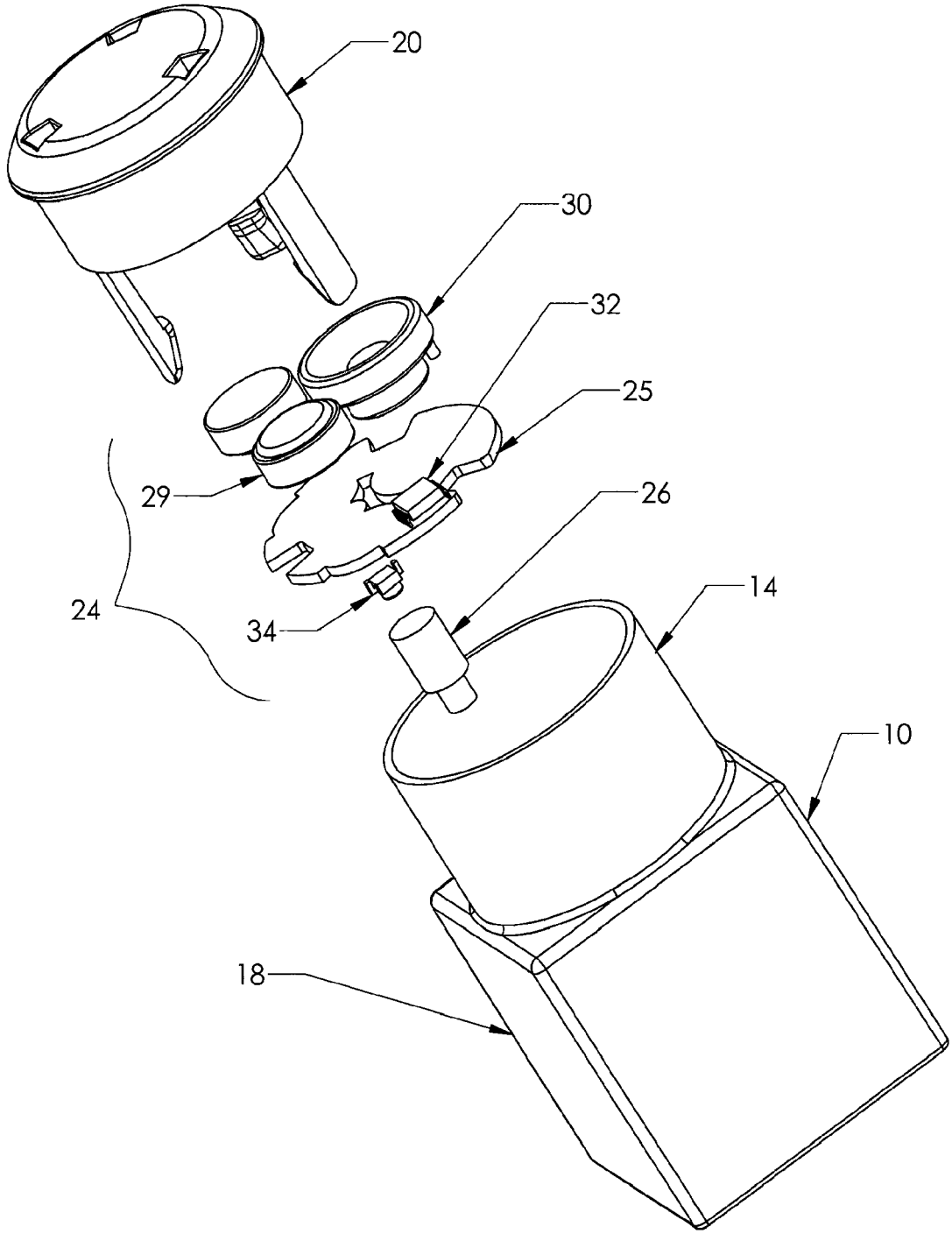
FIG. 2 is an exploded view of the block of FIG. 1 illustrating the separated components.
Figure 3:
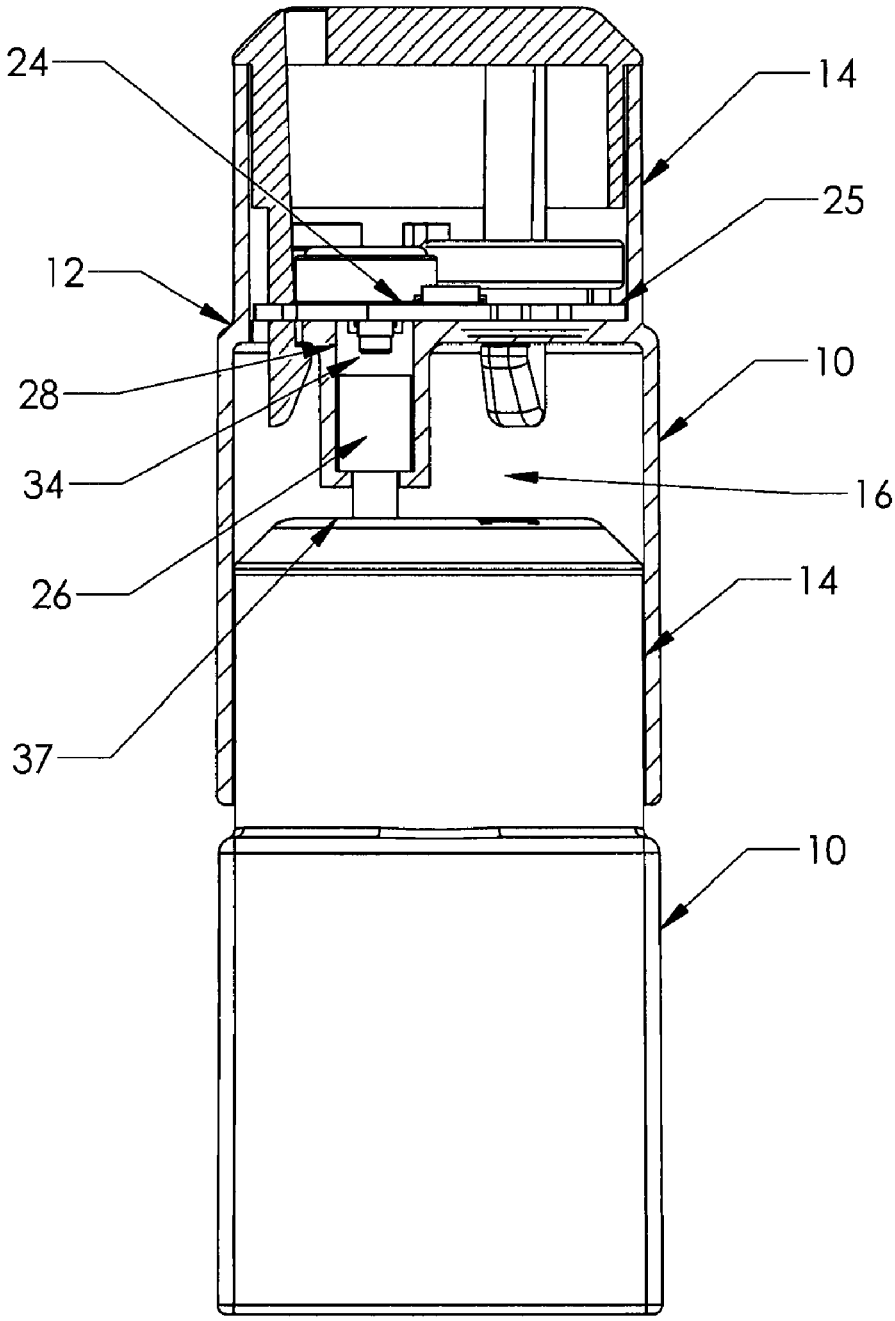
FIG. 3 is a side elevation view, partially sectioned, illustrating the building block of FIGS. 1 and 2 connected to another building block.

FIGS. 1 to 3 illustrate a single post building block 10 forming part of a first embodiment of a building block set. As illustrated in FIGS. 1 and 3, the block is generally square or rectangular in shape, and has a first end 12 from which a single cylindrical post 14 projects. The second end 15 has a cavity or recess 16 designed to receive the post 14 of a second block 10, as illustrated in FIG. 3.

The post 14 and recess 16 comprise first and second connector portions which allow the block 10 to be connected to mating second and first connector portions, respectively, of other blocks in the system. FIG. 3 illustrates the post or first connector portion 14 of a second block engaging in the cavity or second connector portion 16 of the block 10. A third block may be attached to the post 14 of the first block 10 in a similar fashion, and additional blocks may be attached to the top or bottom of the assembled blocks as desired. In the illustrated embodiment, the first connector portion comprises a male connector or post, while the second connector portion comprises a mating female connector or recess, but this may be reversed in alternative embodiments.

As illustrated in FIG. 2, the block 10 comprises an outer housing 18, an end cap 20 designed for releasable snap engagement on the inside of post portion 14 of the housing 18, and a control circuit assembly 24 mounted inside the end cap via a mounting plate or printed circuit board 25. A spring-loaded push pin 26 extends through a pin guide bore 28 inside the housing and has an end which projects into recess 16 and engages the upper end of a post 14 of a second block attached to the first block, as indicated in FIG. 3.

The control circuit assembly comprises a power source such as one or more batteries 29, a speaker 30, a voice chip 32, and a push button switch 34, all mounted on printed circuit board 25. When the single post block 10 of FIG. 1 is attached on top of a second block as illustrated in FIG. 3, the push pin 26 is pushed up by the end face 37 of the second block's post 14, operating the push button switch 34 to activate the voice chip 32 and produce an audible output. The end face 37 comprises an actuator formation which operates switch 34 when the post 14 is fully engaged in the cavity of another block 10.

In one embodiment of the building block set, the blocks 10 all have a single post and some blocks are smart blocks 10 as in FIGS. 1 and 2 which contain a control circuit assembly for producing an audible output, while others contain no electronics. The smart blocks 10 may each have a different appearance, such as different colors, and the audible output produced when each smart block is attached to a second block as indicated in FIG. 3 may comprise a description of the appearance of the block along with some other interesting statement. For example, a blue colored block may produce the output, "Hello, I am blue and I love to build".

The blocks in the building block set of FIGS. 1 to 3 may be provided in different sizes, including the single post block 10, and other, larger blocks such as a double block having two posts 10, in order to provide an expanded range of building options. In this case, the audible output may include a size indication, such as "Hello, I am blue two and I love to build". In another embodiment, the output may be visual, such as actuation of one or more light emitting diodes (LEDs), or a combination of audible and visual outputs, such as a siren sound and flashing lights, for example.

Figure 4:
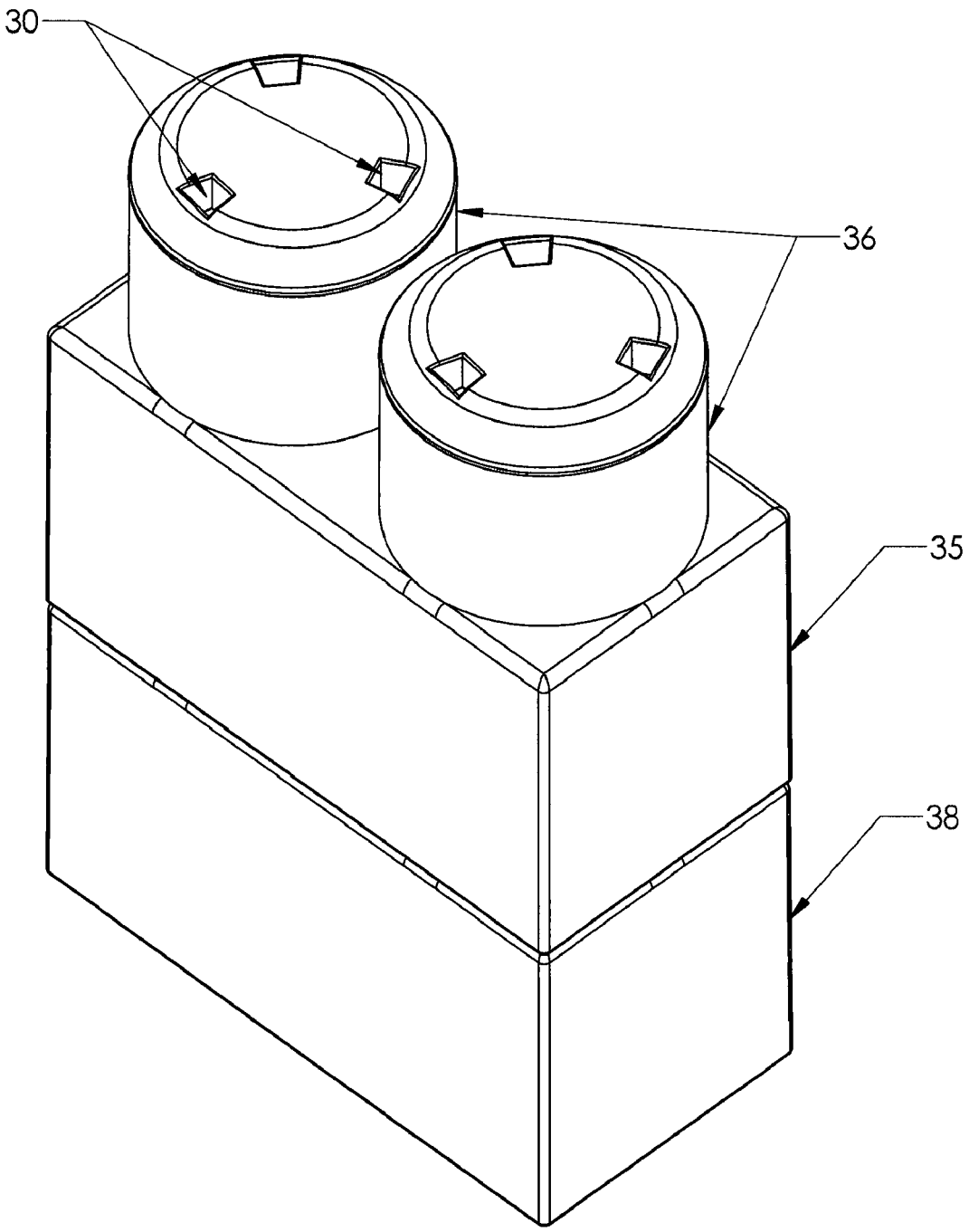
FIG. 4 is a perspective view of an alternative, two post building block forming part of the building block set, attached to another two post building block.
Figure 5:
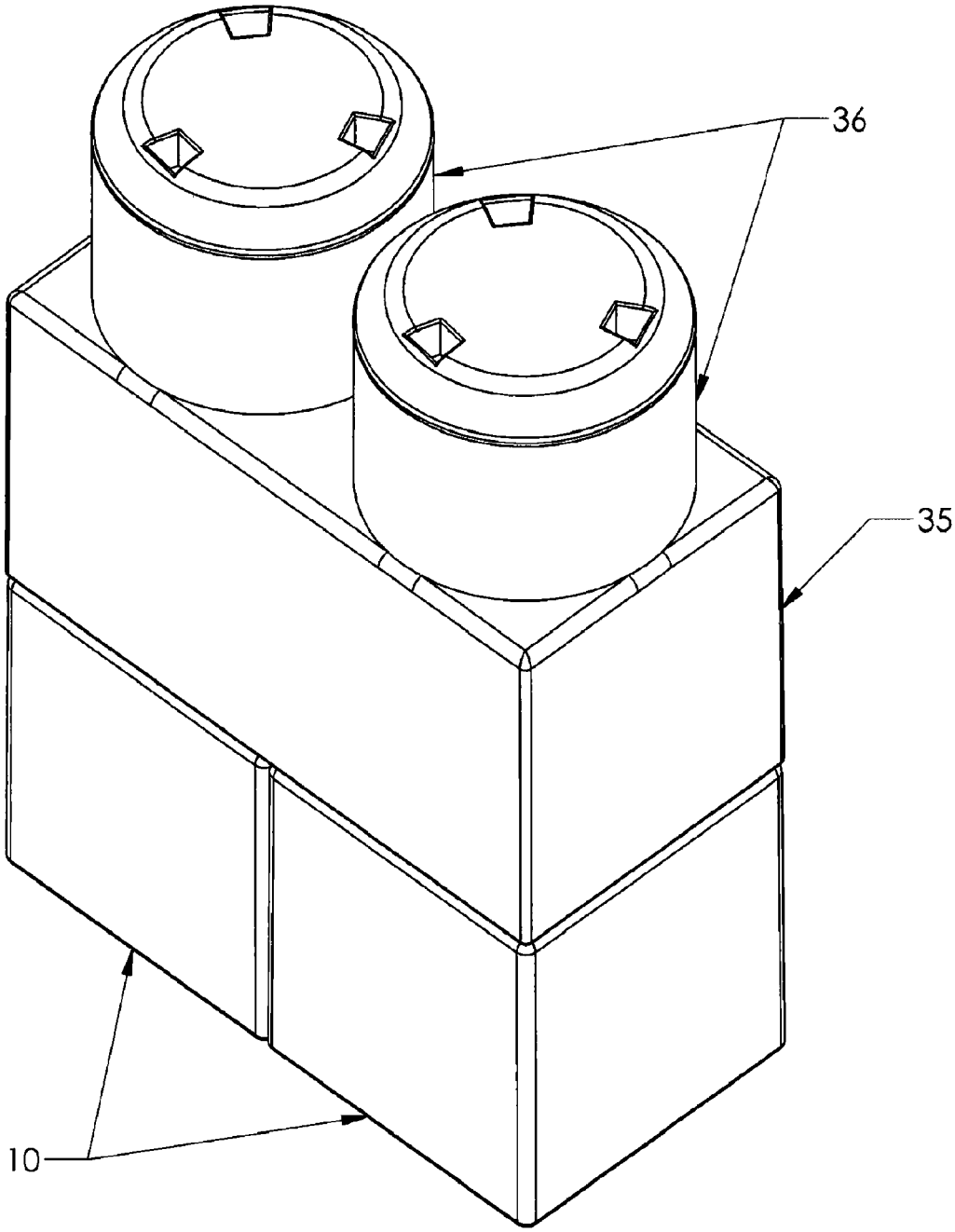
FIG. 5 is a perspective view of the two post building block of FIG. 4 attached to two one post building blocks.

FIGS. 4 and 5 illustrate an embodiment of a two post block 35 which is double the size of block 10 and which has two posts 36 projecting from a first end and corresponding recesses or cavities (not visible) at the other end for mating engagement with posts of other blocks. A speaker opening 30 may be built into one or both of the posts 36. The two post block 35 may form part of the building block set of FIGS. 1 to 3, and two post smart blocks which provide audible or other sensory outputs may be provided in addition to two post building blocks containing no electronics, i.e. non-smart blocks. As illustrated in FIG. 4, the two post smart block 35 may be secured to a second block 38, which may be smart or non-smart. Second block 38 has two posts equivalent to posts 36 which engage in recesses in the lower end of the smart block 35 and activate push pins to produce an audible output. Alternatively, as illustrated in FIG. 5, two post smart block 35 may be secured to two single post blocks 10, which may themselves be smart or non-smart. In each case, other blocks may be secured on top of block 35 in a similar manner.

Figure 6:
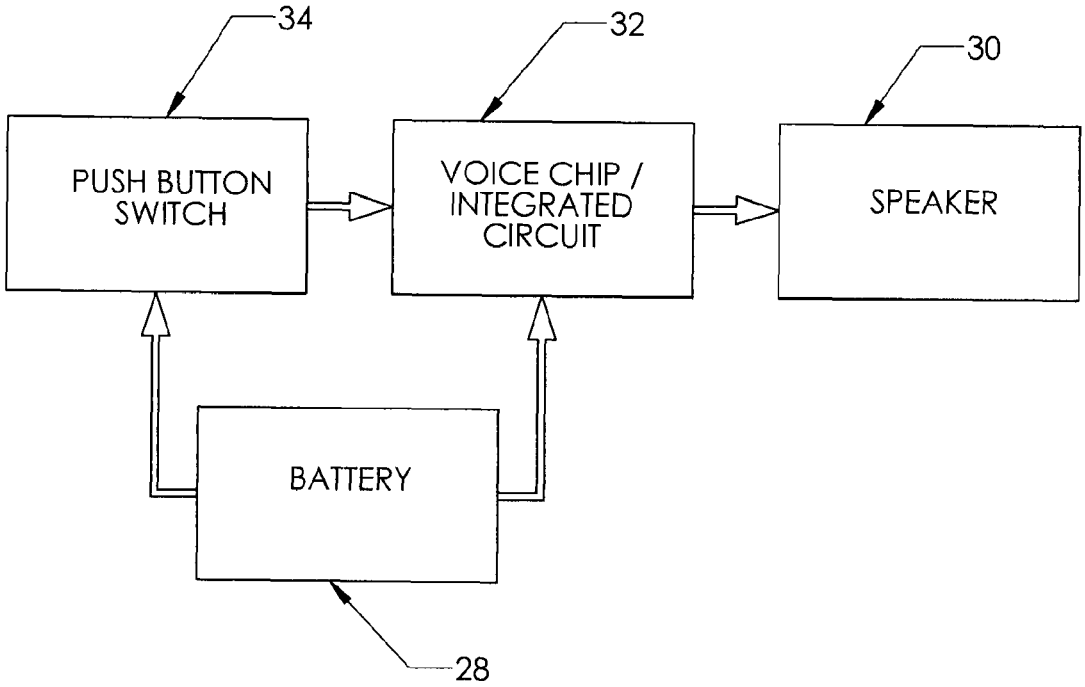
FIG. 6 is a block diagram of a control circuit provided in at least some of the building blocks of FIGS. 1 to 5.
Figure 7:
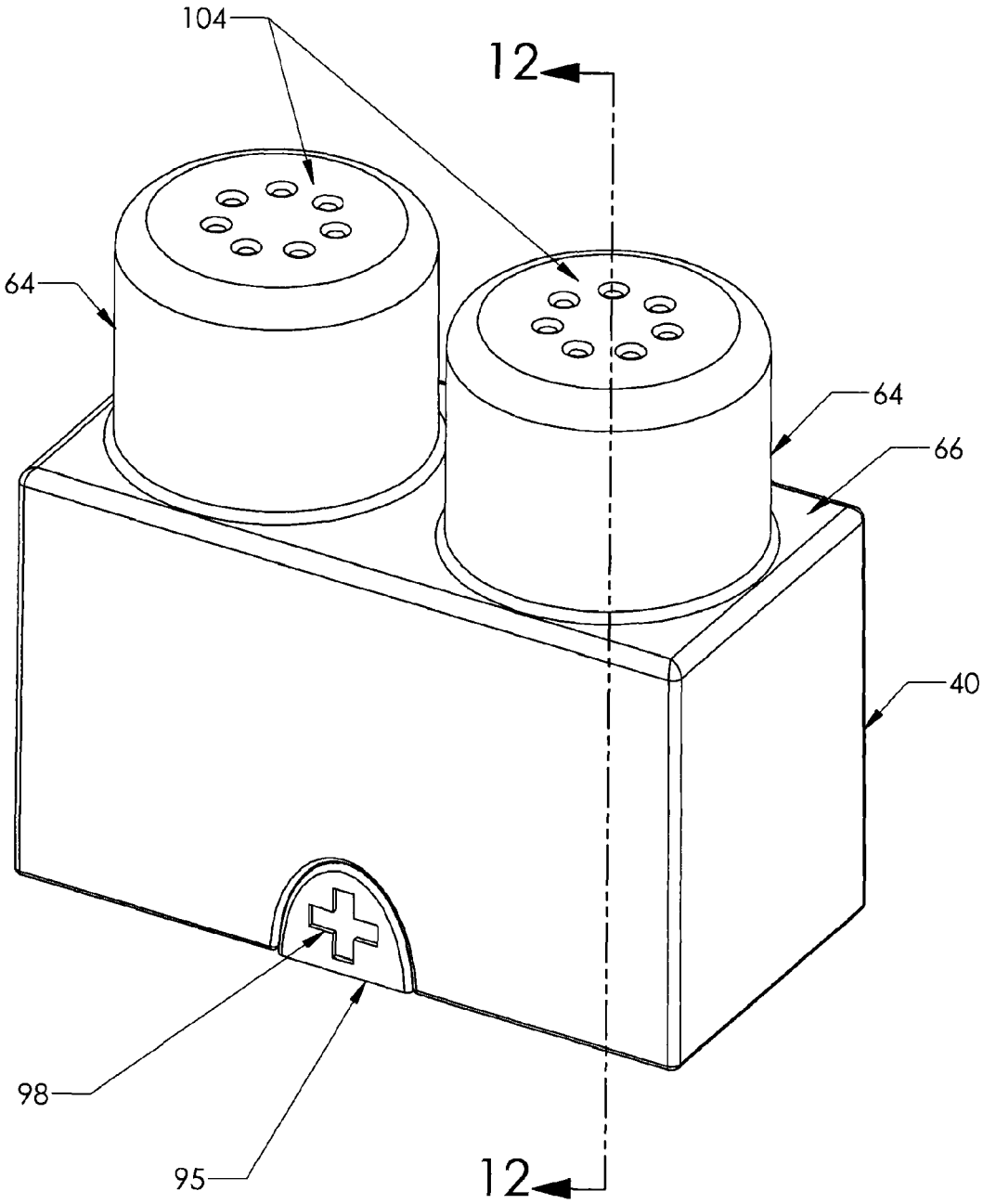
FIG. 7 is a top perspective view of a two post smart block forming part of a second embodiment of a building block set.

FIG. 6 is a schematic block diagram of one embodiment of a control circuit which may be provided in a single or double post smart block 10 or 35 as described above. Different smart blocks may have different voice outputs depending on their characteristics, such as color, number, shape, or other indicia. Other smart blocks may have LEDs and may produce visual outputs or a combination of audible and visual outputs. Different color smart blocks may identify themselves as to their color alone, or their color and size, or some other characteristic, and are programmed to make different types of statements. In one embodiment, the smart blocks may also have different voices and personalities, to add to a child's interest when playing with the blocks. A child is able to play with just a few blocks, or with a plurality of blocks in a manner similar to standard building blocks. The talking feature of the blocks can stimulate interest and learning while the child is absorbed in the creative aspects of building.

FIGS. 7 to 18 illustrate a second embodiment of a building block system. The system comprises a number of standard blocks in different sizes, as illustrated in FIGS. 13A to 13L, and a number of smart blocks which perform different functions, such as identifying colors, identifying shapes, identifying numbers, identifying various indicia, and performing mathematical functions. Each smart block contains electronics for performing the designated function, while the standard blocks contain no electronics but have actuators which activate the electronics in a connected smart block to perform the designated function.

Figure 13A:
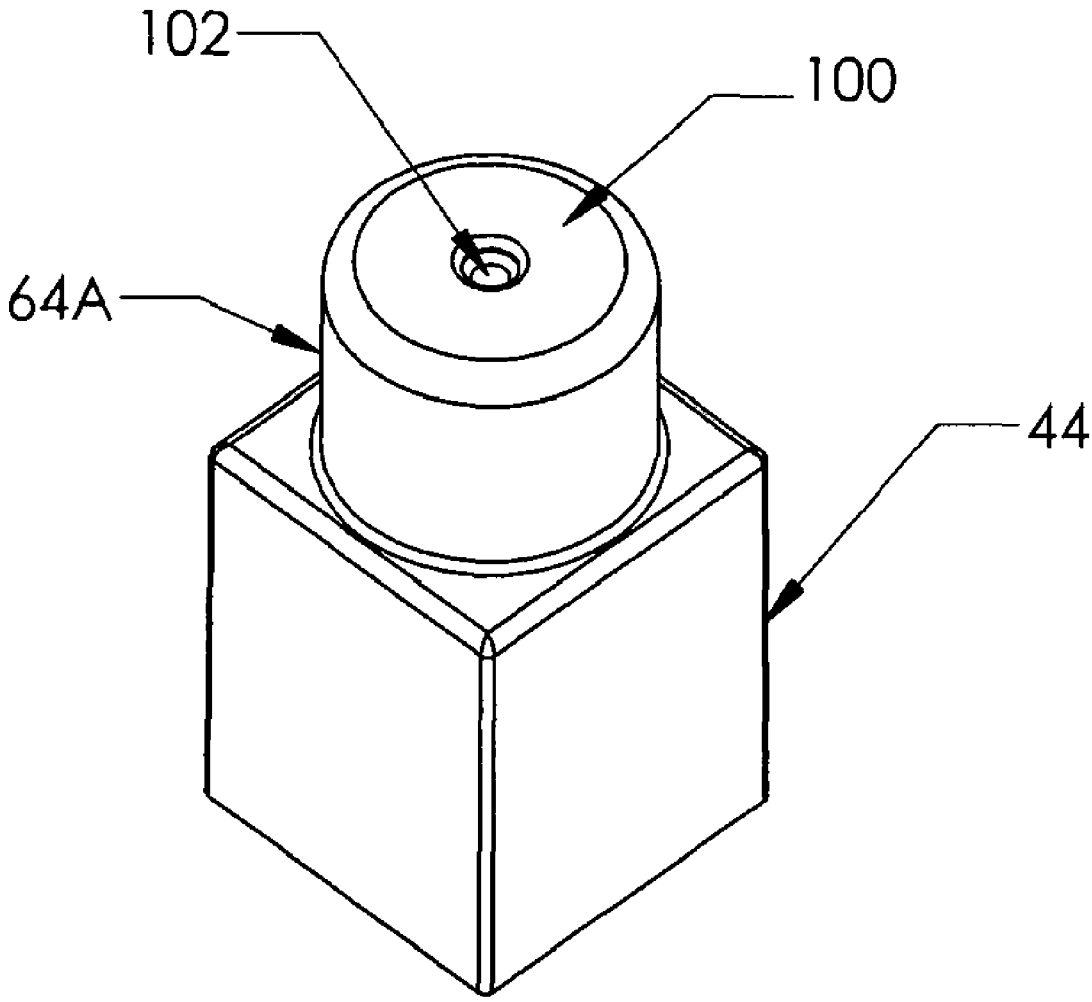
FIGS. 13A to 13L are top perspective views of different building blocks which may be used together with smart blocks as illustrated in FIGS. 7 to 12 to form the modified building block set.
Figure 13B:
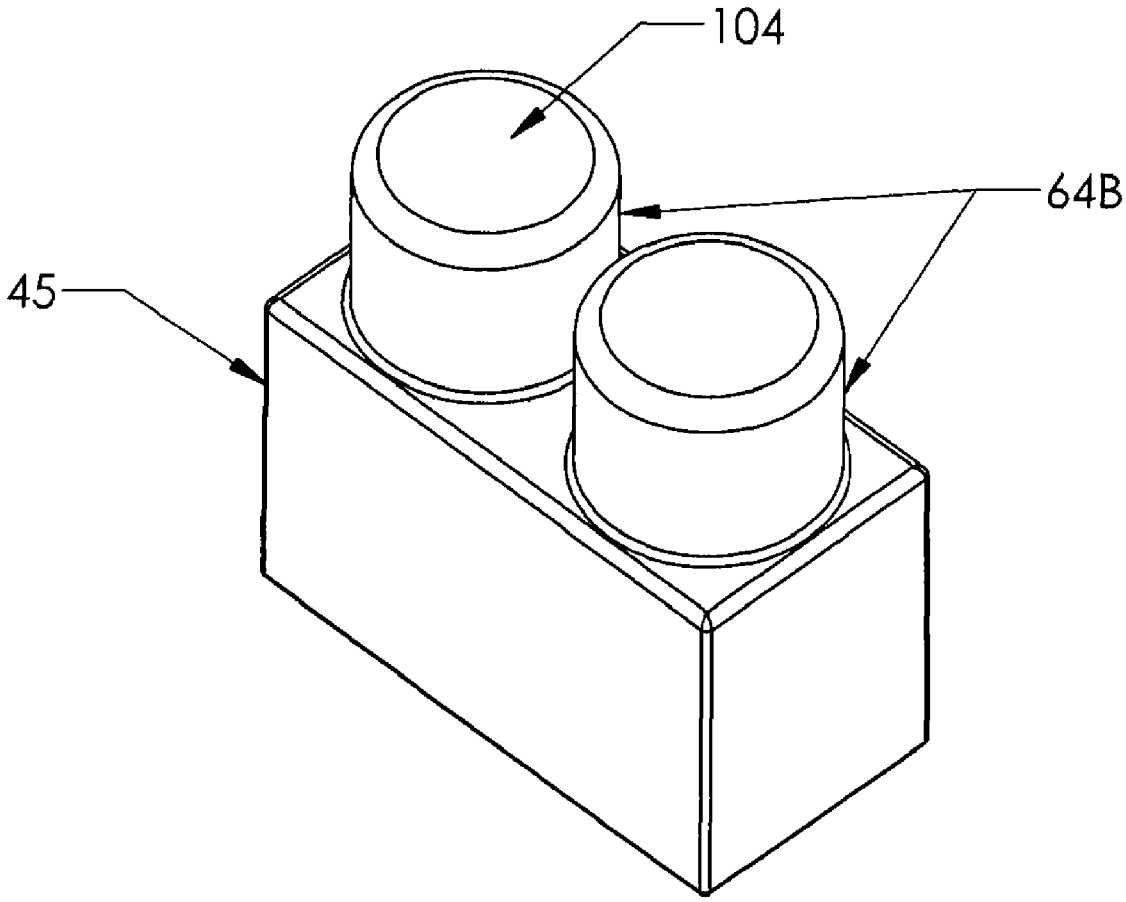
Figure 13C:
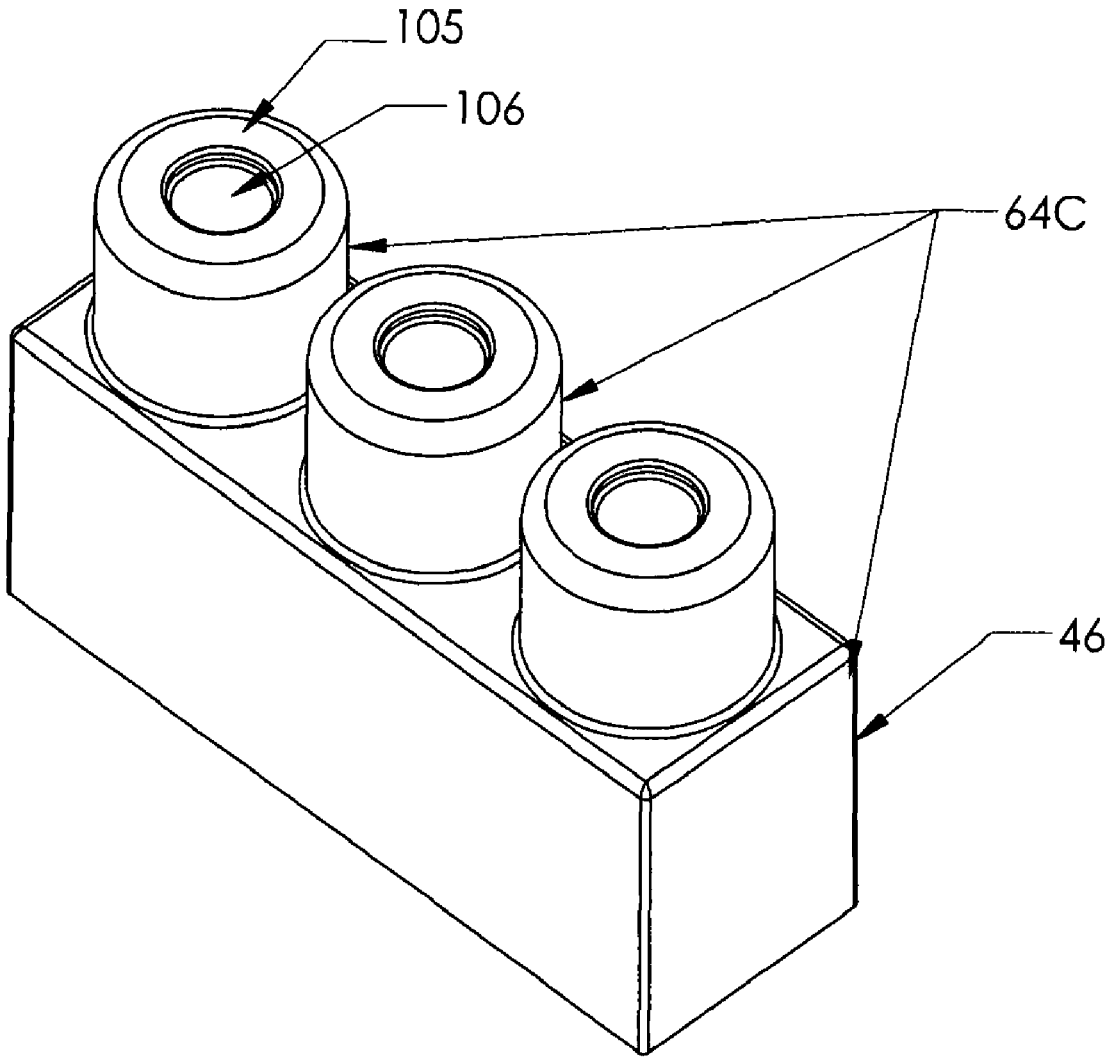
Figure 13D:
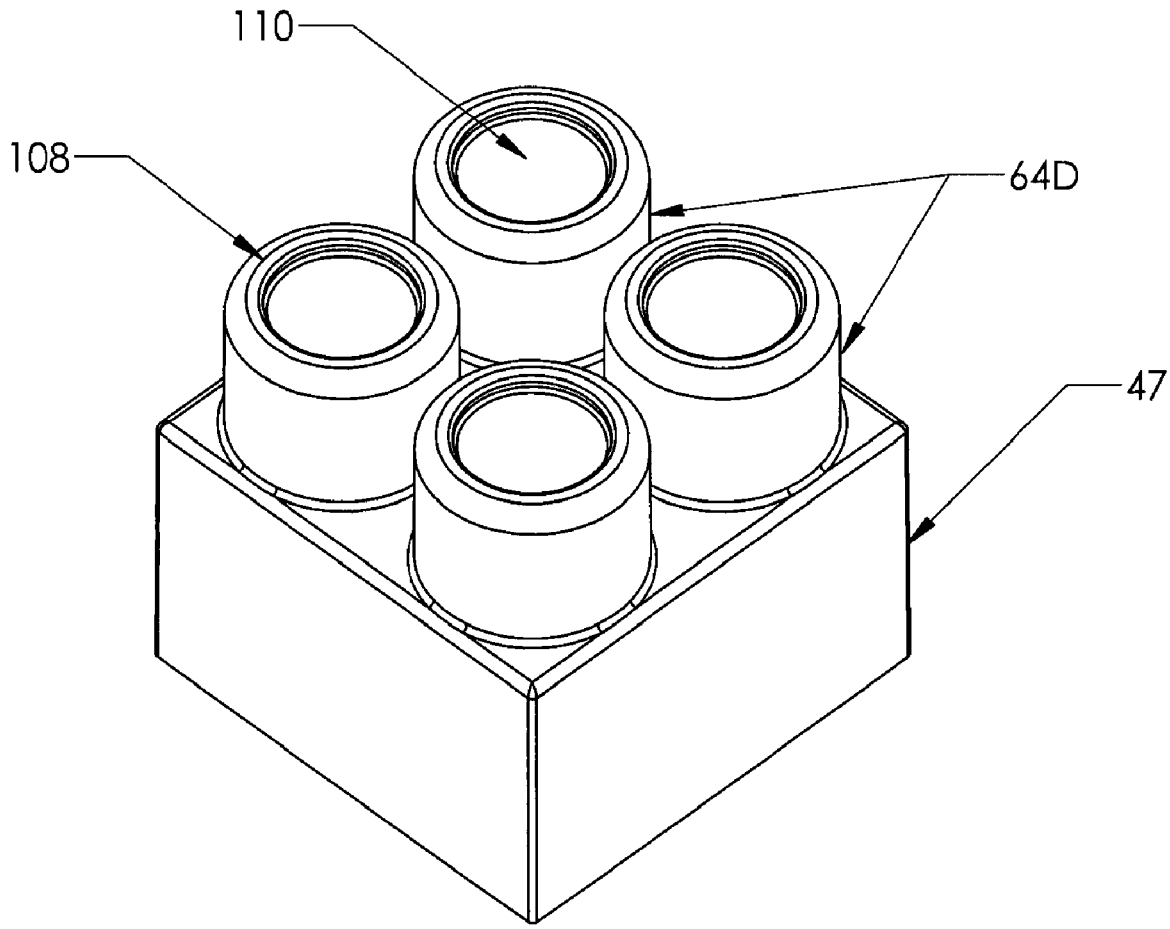
Figure 13E:
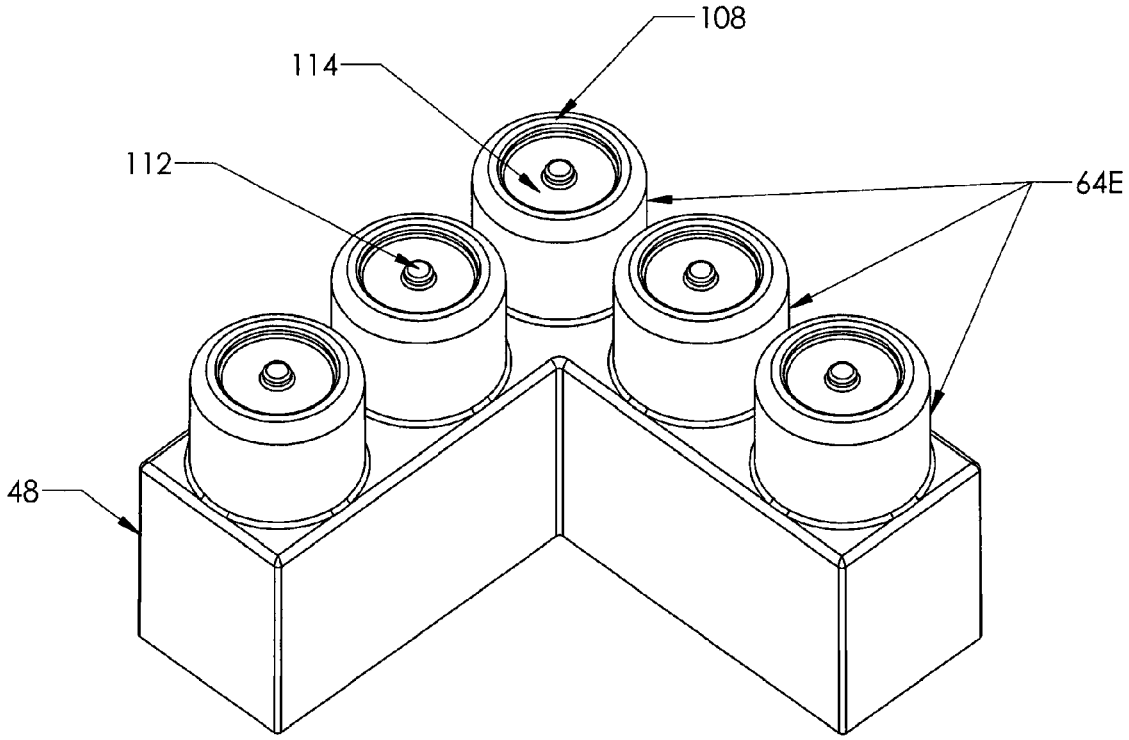
Figure 13F:
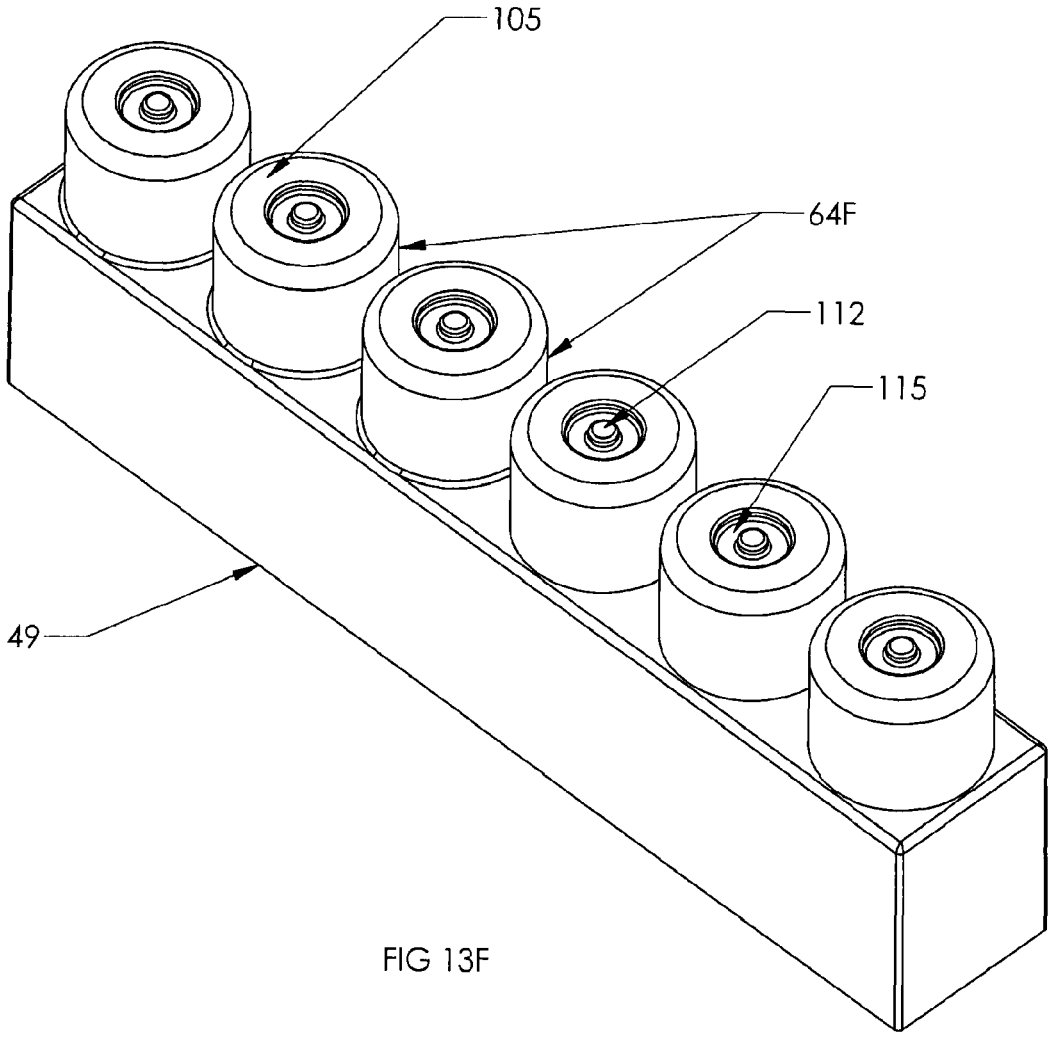
Figure 13G:
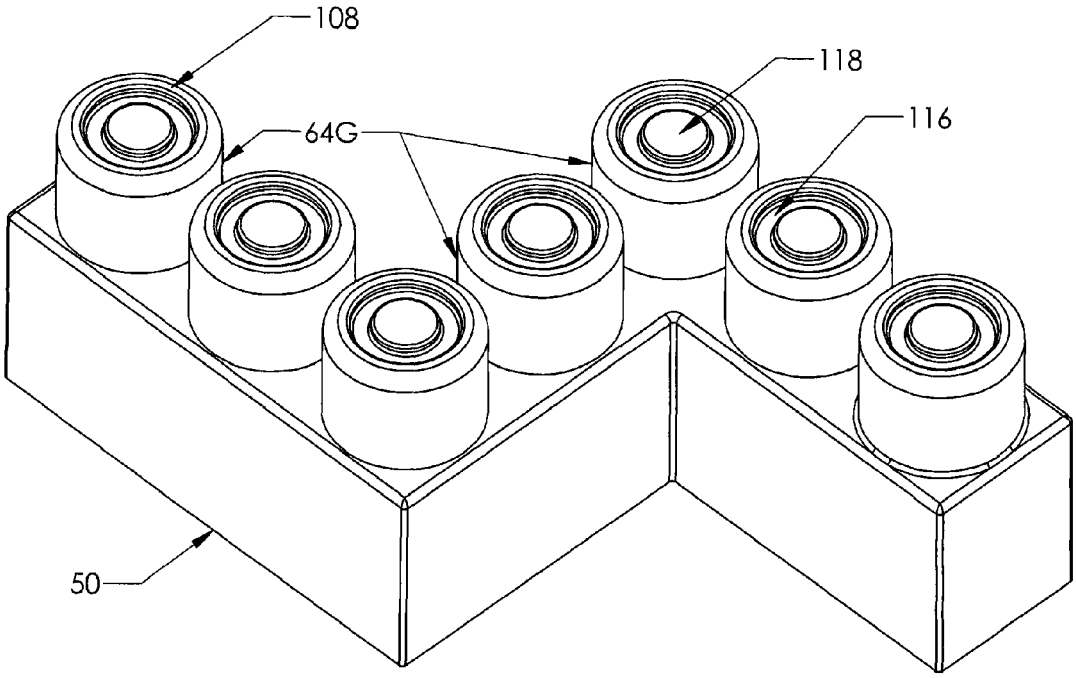
Figure 13H:
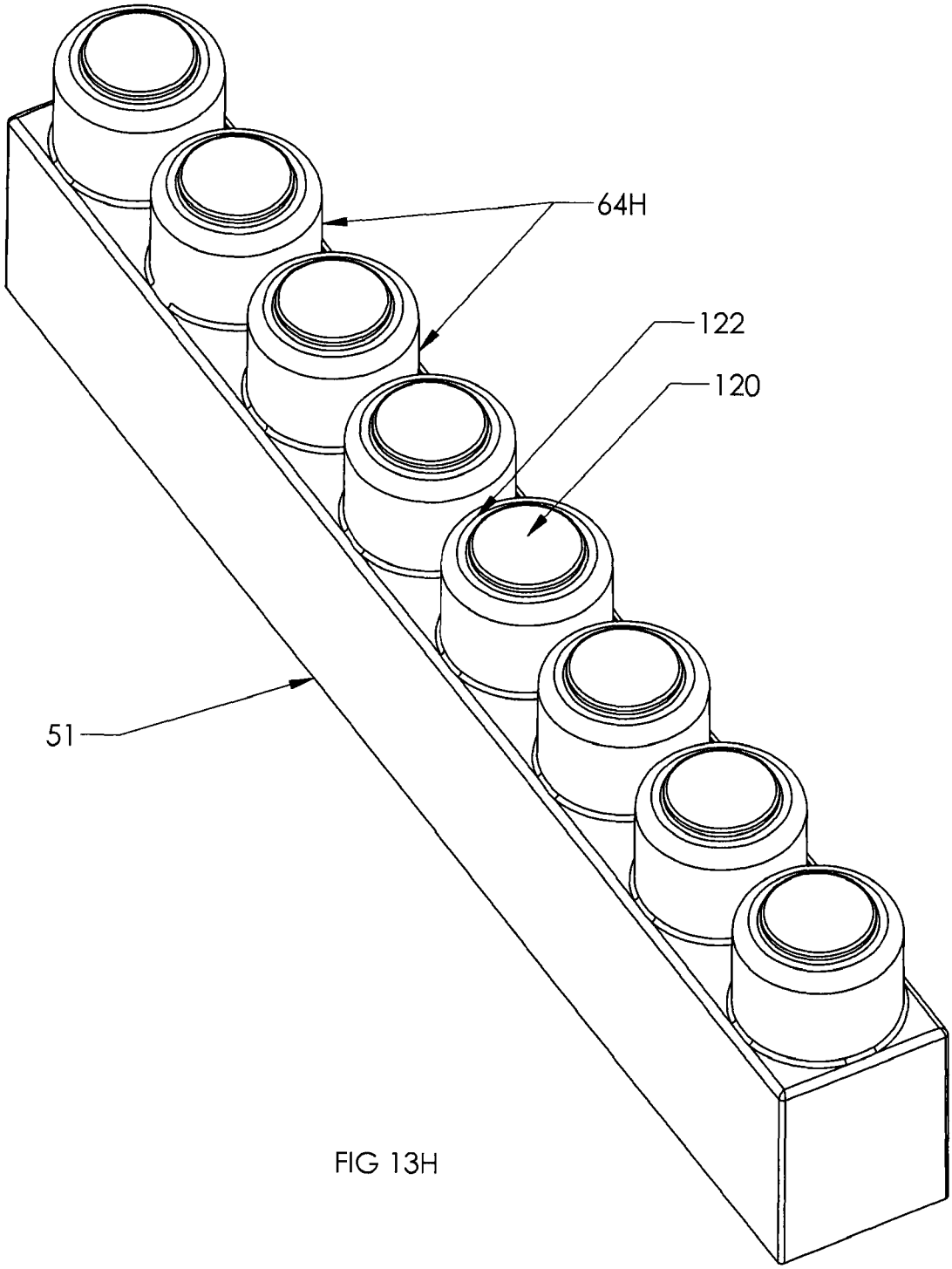
Figure 13I:
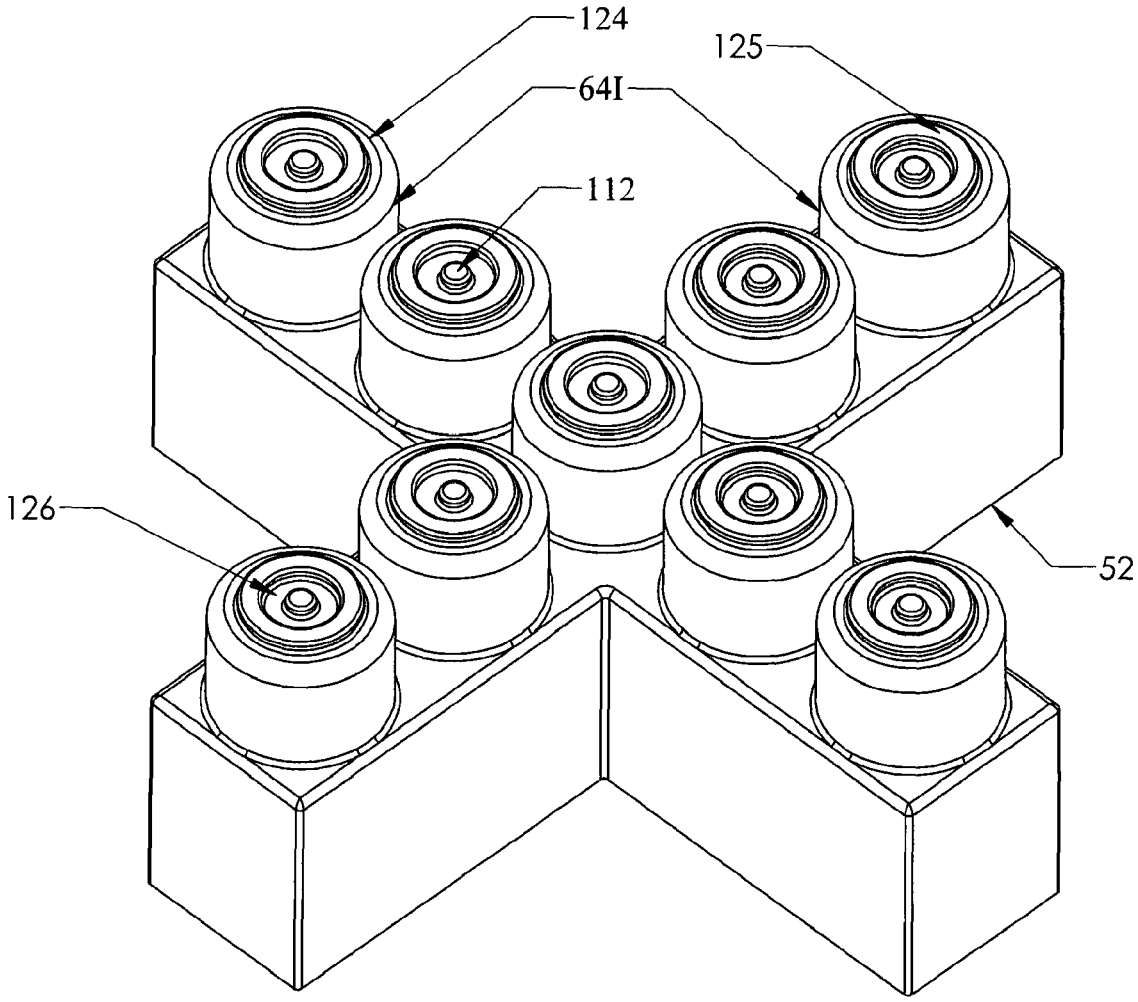
Figure 13J:
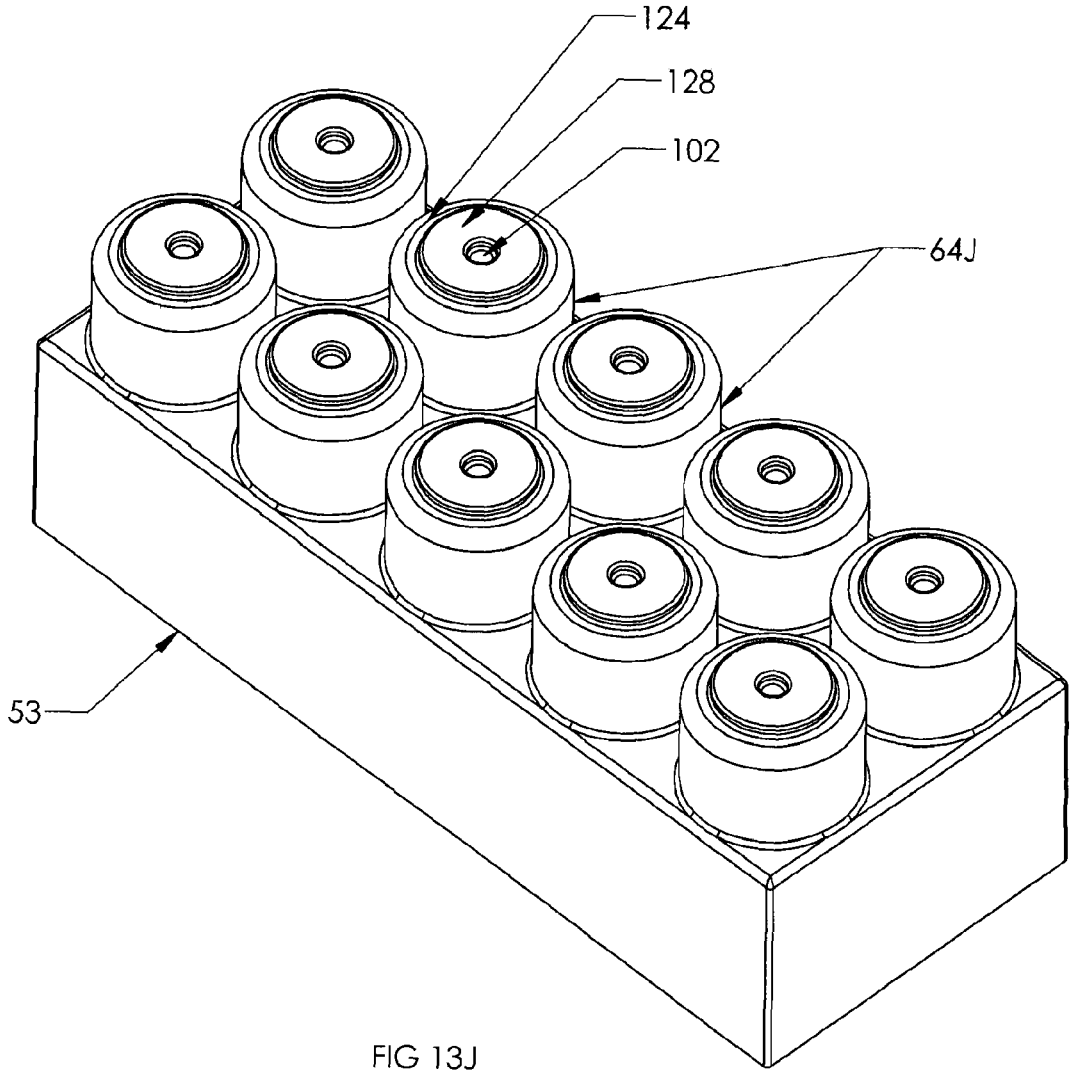
Figure 13K:
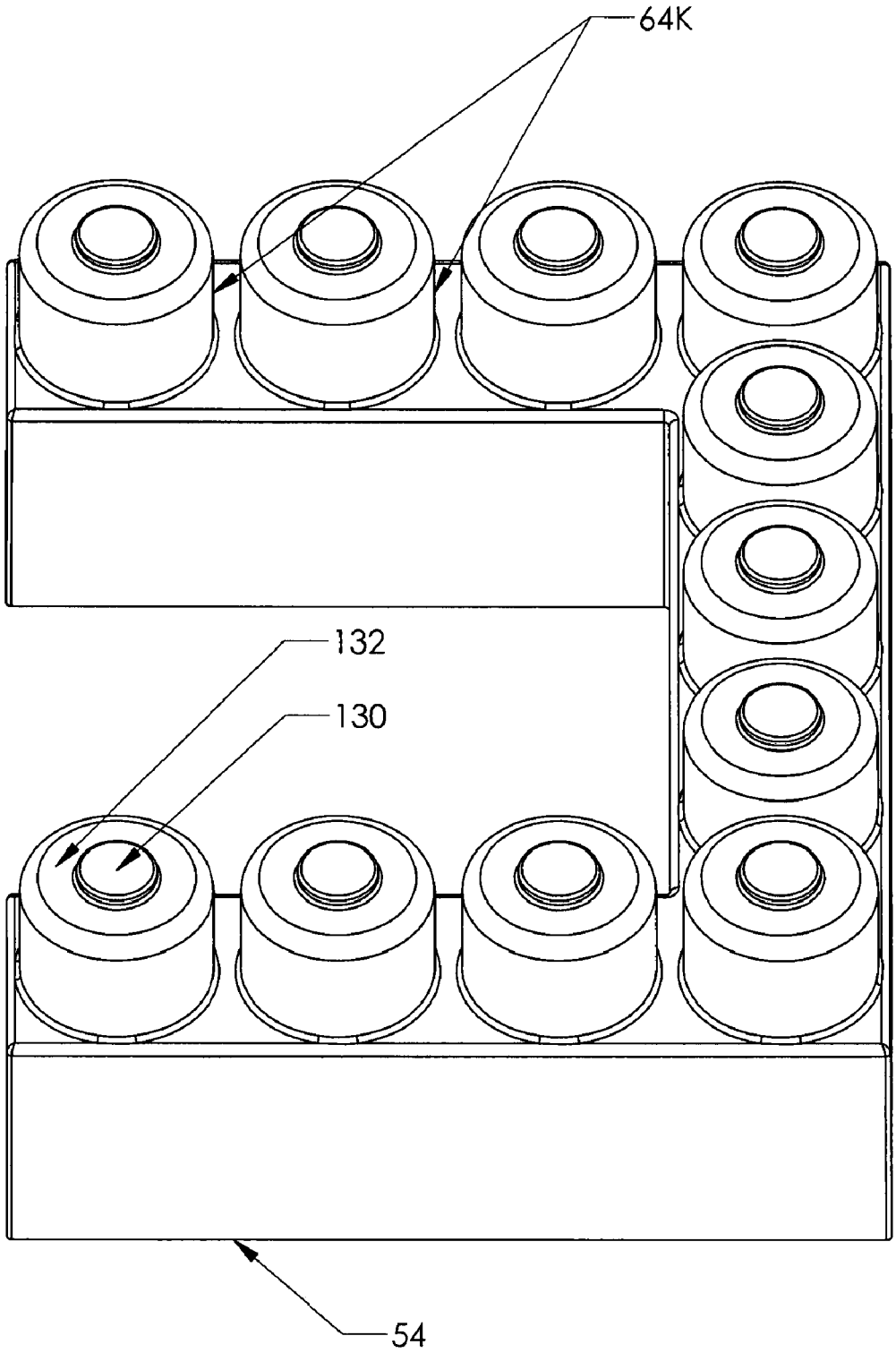
Figure 13L:
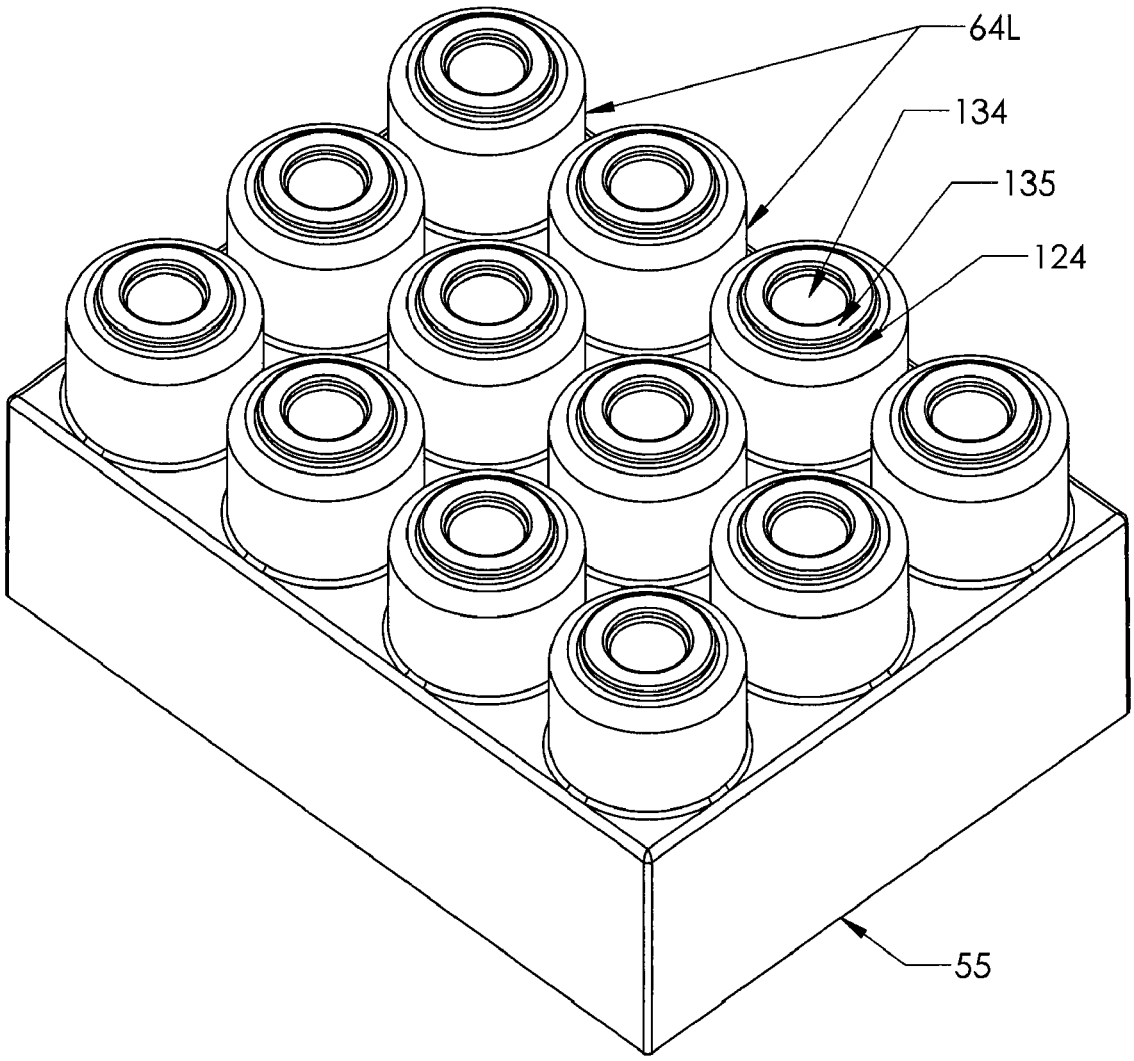

FIGS. 7 to 12 illustrate one embodiment of a smart block 40 of this system, while FIGS. 13A to 13L illustrate one embodiment of a set of twelve different standard blocks. Each standard block has a different number of projecting posts, as indicated below:

FIG. 13A=One post block 44
FIG. 13B=Two post block 45
FIG. 13C=Three post block 46
FIG. 13D=Four post block 47
FIG. 13E=Five post block 48
FIG. 13F=Six post block 49
FIG. 13G=Seven post block 50
FIG. 13H=Eight post block 51
FIG. 13I=Nine post block 52
FIG. 13J=Ten post block 53
FIG. 13K=Eleven post block 54
FIG. 13L=Twelve post block 55

This is just one possible example of a set of twelve blocks representing the numbers 1 to 12, and other geometrical configurations may be used for the larger blocks in alternative embodiments. For example, the five post block 48 of FIG. 13E may be a straight line rather than an L-shape, the nine post block 52 of FIG. 13I may be a 3×3 square rather than a cross shape, and so on. The only requirement is that each block has one or more posts of the same size and configuration as the posts on other blocks, apart from the end face which has different actuator formations for actuating different combinations of switches in the smart blocks, as discussed in more detail below.

In this embodiment, the smart blocks 40 are identical in external size and shape to a two post standard block 45 as illustrated in FIG. 13B, with the difference being that the smart blocks contain electronics and one or more speakers with outputs at the top of one or both posts 64, as described in more detail below in connection with FIG. 10. The two post smart blocks 40 are also similar or identical to the two post block 35 of the previous embodiment, and the system of FIGS. 7 to 18 may be designed as an add-on to the simpler system of FIGS. 1 to 5 for purchase as a child grows older.

Figure 8:
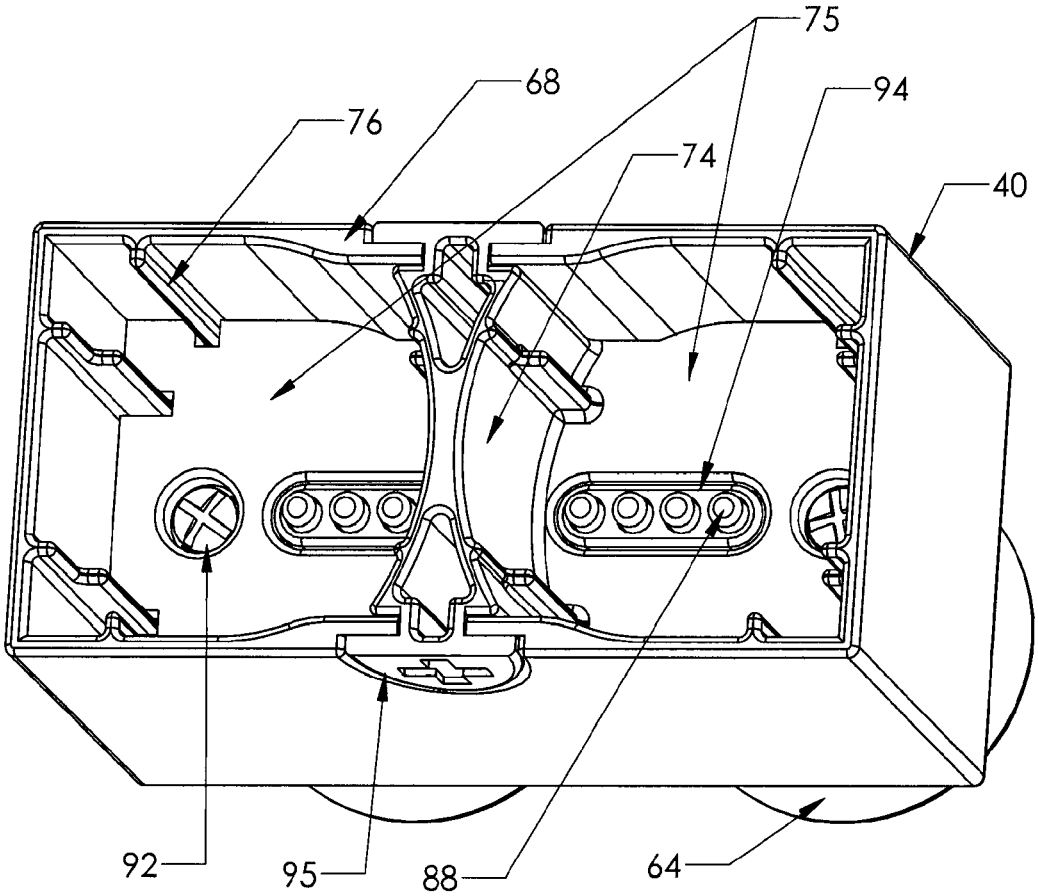
FIG. 8 is a bottom perspective view of the smart block of FIG. 7.
Figure 9:
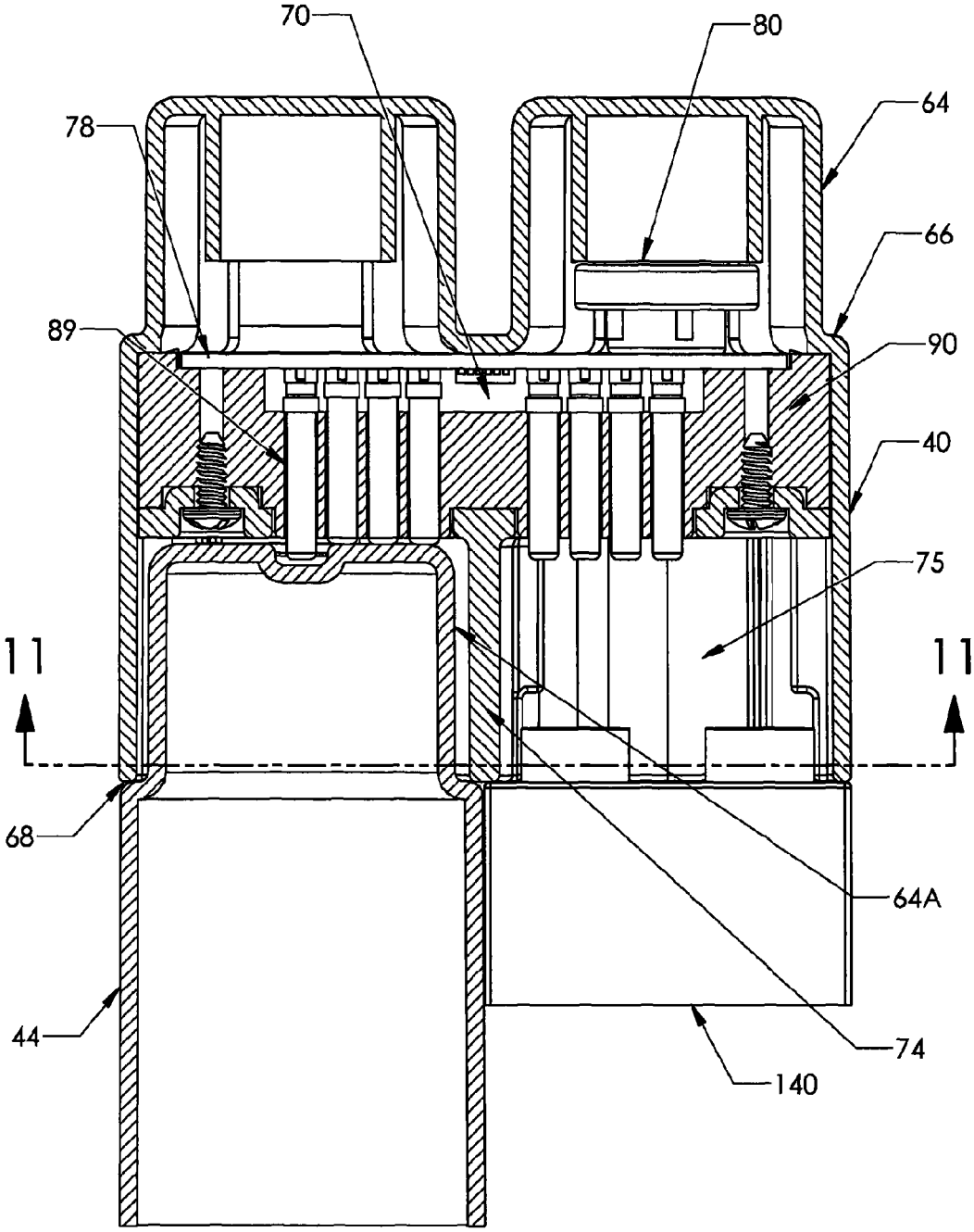
FIG. 9 is a side elevation view of the smart block of FIGS. 7 and 8 attached to a standard block of the building block set and to a standard Lego® type block.
Figure 10:
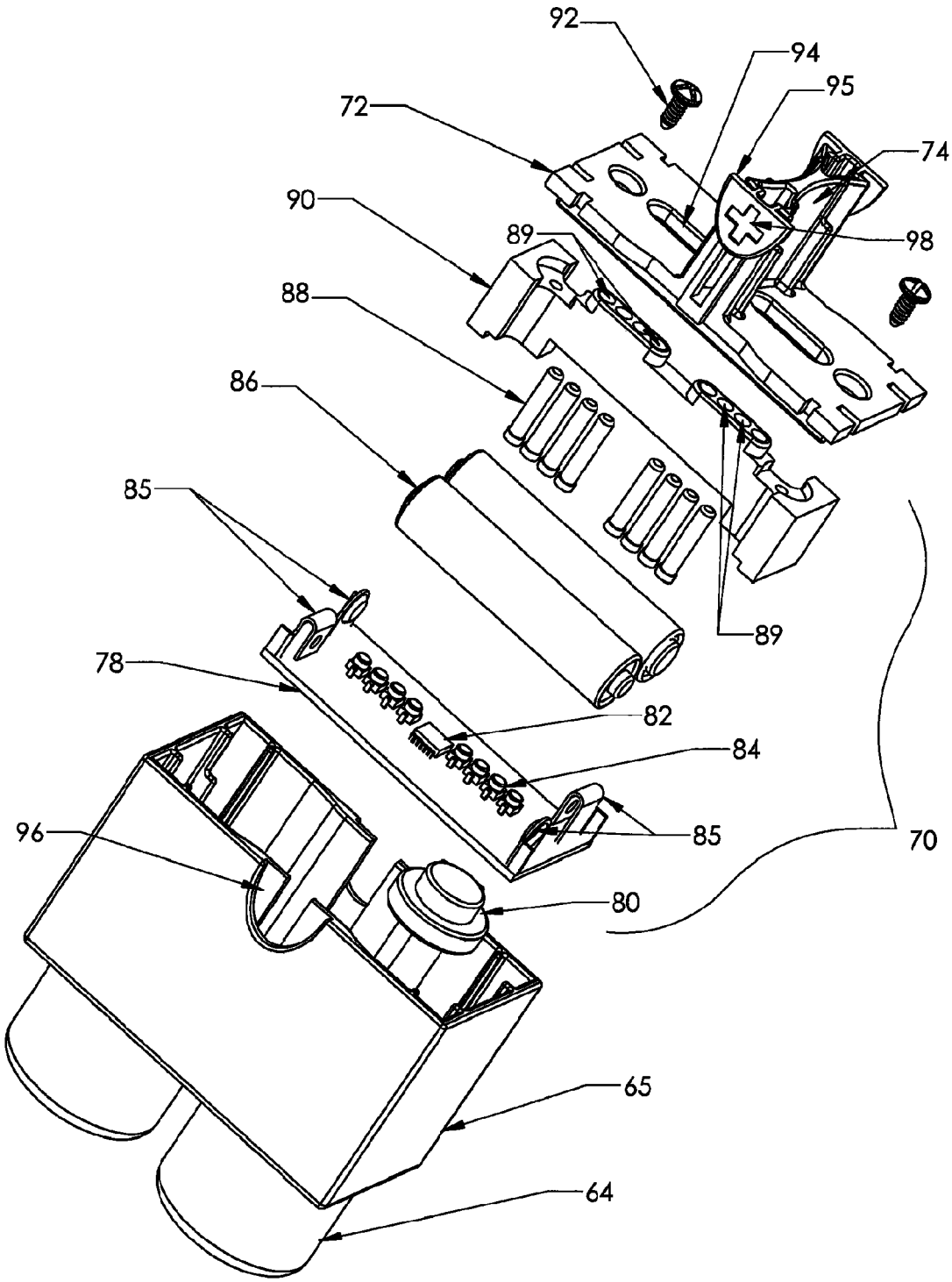
FIG. 10 is an exploded view of the block of FIGS. 7 to 9, illustrating the separated components of the block.
Figure 11:
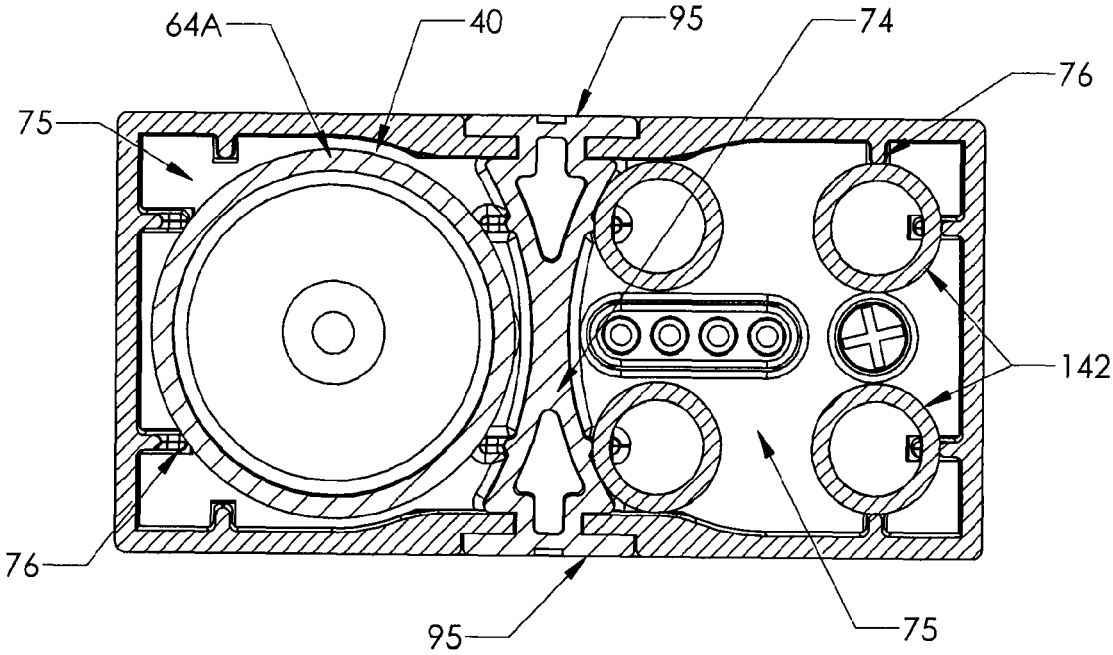
FIG. 11 is a cross-sectional view on the lines 11-11 of FIG. 9.
Figure 12:
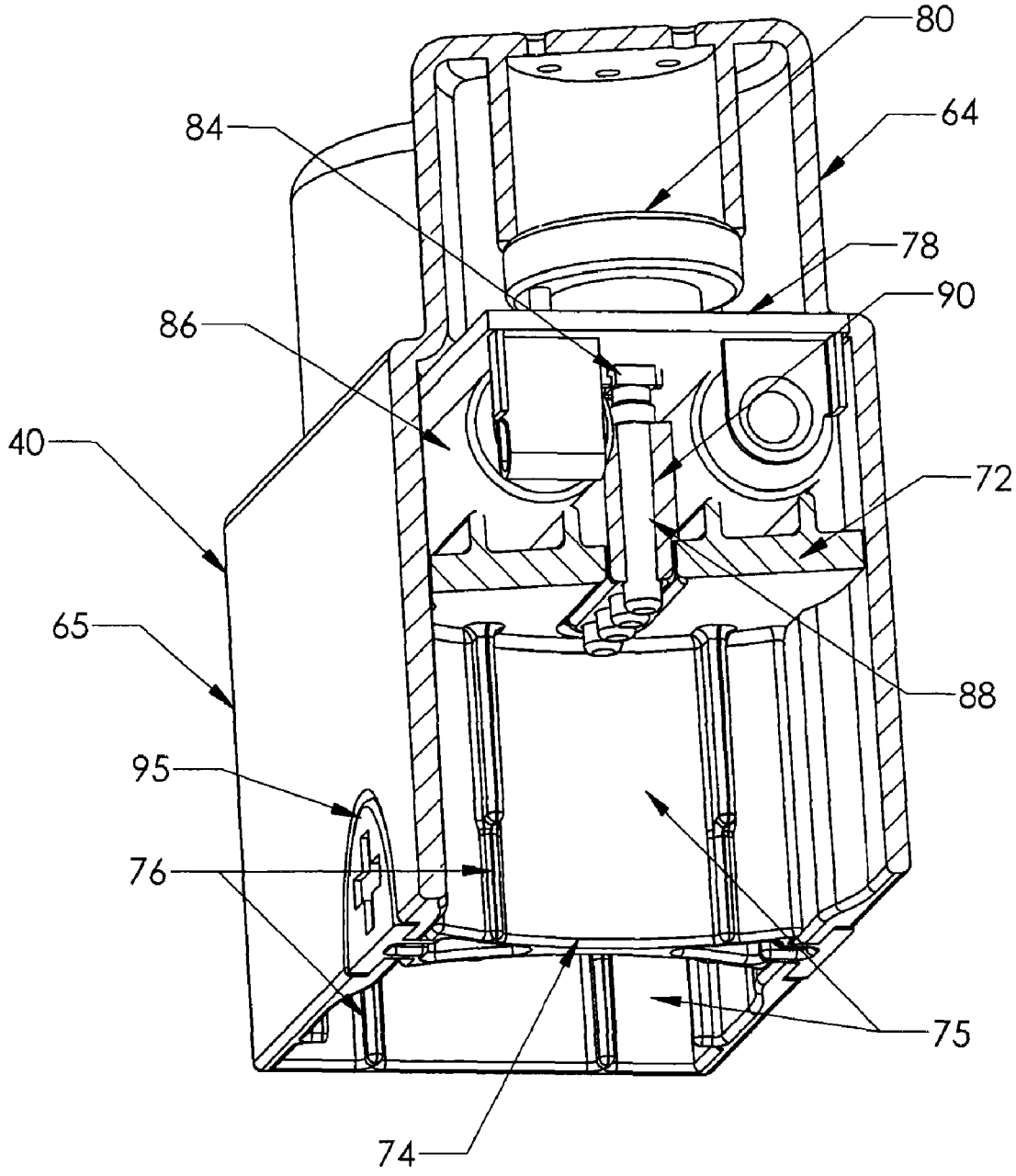
FIG. 12 is a cross-sectional view on the lines 12-12 of FIG. 7.

As illustrated in FIGS. 7 to 12, smart block 40 comprises an outer housing 65 of generally rectangular shape having two posts 64 projecting from a first end 66 and open at the second end 68. An electronics unit 70 (see FIG. 10) is mounted inside the housing and is held in position by a cover plate 72 which is recessed inside the housing when installed, as seen in FIGS. 8, 9 and 12. As seen in FIG. 8, the cover plate has a central projecting wall formation 74 which divides the recessed end portion of the housing into two recesses or cavities 75 designed for mating engagement with posts on one or more standard or smart blocks. The inner walls of the housing 65 and opposite faces of wall formation 74 have a plurality of ribs 76 which allow the smart block to be compatible with conventional building blocks such as Lego® blocks, as explained below, as well as with the standard or non-smart building blocks of this embodiment which are illustrated in FIGS. 13A to 13L.

Figure 10A:
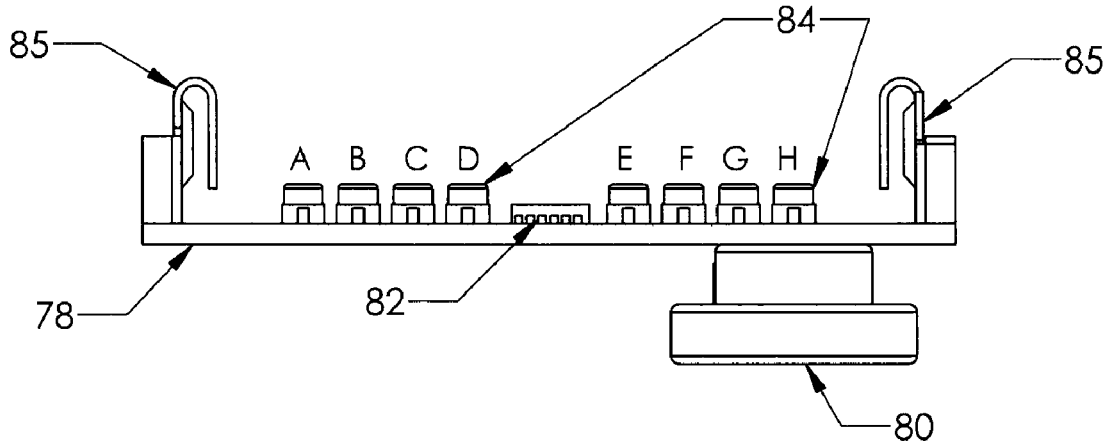
FIG. 10A is a side elevation view of the printed circuit board of FIG. 10.

The electronics unit 70 comprises a circuit board 78 on which a number of electronic components are mounted. As illustrated in FIGS. 10 and 10A, a speaker 80 is mounted on a first side of board 78, while a processor or integrated circuit (IC) chip 82 is mounted on the second side. A row of push button switches 84 are mounted on the second side of board 78 on opposite sides of IC chip 82, with an array of four switches 84 in a row on each side of the chip 82, as seen in FIG. 10A. The arrays of switches 84 are labeled A, B, C, D, and E, F, G, H. Two opposing pairs of battery terminals 85 are also mounted on board 78 for receiving a standard battery 86 on each side of the IC chip and switches. Other types of power source may be used in alternative embodiments. Each switch 84 is associated with a respective push pin actuator 88. The push pins or actuators 88 extend through guide bores 89 in a push pin housing 90 mounted between the circuit board 78 and the cover plate 72. A central portion of housing 90 extends between the batteries in alignment with the row of push button switches, as seen in FIGS. 10 and 12. The pin housing 90 may be secured in the smart block housing in any suitable manner, for example with adhesive, screw fasteners, or the like, and the cover plate 72 is secured to the pin housing with screw fasteners 92. Cover plate 72 has slots or openings 94 aligned with the two rows of push pins 88, and the ends of the push pins project through the openings 94, as seen in FIGS. 8 and 9.

When the electronics control unit 70 and cover plate 72 are secured in the housing, opposite end plates 95 of dividing wall formation 74 engage in corresponding semi-circular indents or recesses 96 in the side walls of housing 65, as illustrated in FIGS. 11 and 12. The outer face of each end plate 95 may carry a symbol of 98 to indicate the function of the smart block. In the illustrated embodiment, the symbol 98 comprises a plus sign (+), indicating that the block 40 is a math block which performs addition, as explained in more detail below. Other smart blocks may carry indicia such as minus signs (−), multiplication signs (×), division signs (/), or the like, to indicate their function.

The recesses or cavities 75 in each smart block are designed for mating engagement with posts on other smart blocks or non-smart building blocks. Non-smart building blocks of the building block system or toy set of FIGS. 7 to 18 are referred to as standard blocks in the following description. The standard or non-smart building blocks of FIGS. 13A to 13L have similar cavities for building on top of other blocks, but contain no electronics. In this embodiment, a set of twelve different standard (non-smart) blocks 44 to 55 is provided for selective engagement with one or more smart blocks 40, but different numbers and configurations of standard blocks may be provided in alternative embodiments. A building block kit may include a number of standard blocks of each type, along with a number of different smart blocks for performing different functions. The kit may be designed such that a simpler, starter kit may be purchased for a young child or toddler, with add-on kits of increasing complexity being purchased as the child gets older.

Each of the different standard blocks has a different actuator formation or contour on the end face of each projecting post. The actuator formations or contours are in the form of concentric ring patterns of grooves and ribs of various widths, with the simplest contour being the flat end face 104 of the double post block and smart blocks, designed to actuate all four switches associated with a respective cavity. The single post block 44 of FIG. 13A is similar in design to the single smart block 10 of the first embodiment, although it contains no electronics and has a different contour at the end of the single post 64A which projects from one end face. The opposite end of the single block has a cavity or recess identical to one of the cavities 75 of a smart block without any push pins. This cavity can mate with a post on any of the other smart or standard blocks, or with another single block. The actuator formation on the end face of post 64A comprises a generally flat face or ring 100 with a small central circular indent or recess 102.

The two post or double block 45 is twice the size of single block 44 and has a pair of posts 64B each of the same shape and dimensions as posts 64 on the smart blocks and post 64A on the single block. The posts 64 on the smart blocks and the posts 64B on the standard double block 45 each have the identical actuator formation on their outer ends, comprising a completely flat and uninterrupted end face 104. Speaker openings (not illustrated) are provided in the end face of at least one post 64 on the smart blocks 40. The block 45 has post receiving cavities or recesses for receiving the posts of one or more additional blocks, which are substantially identical to the post receiving indents or recesses 75 of smart blocks 40 but which do not have any switch actuators or push pins.

The three post or triple block 46 is three times the size of a single block 44 and has three posts 64C each of the same general shape and dimensions as the posts on the other blocks, but with a different actuator formation on their end faces, comprising an outer rim or annular rib 105 and a central circular depression 106 of larger diameter than the central indent or depression 102 in the single post block 44. The block 46 may have three recesses of similar shape and dimensions to the recesses 75 in the smart block. The four post or quadruple block 47 of FIG. 13D is of generally square shape and has a set of four projecting posts 64D in a square array. Each post 64D has an actuator formation on its outer end comprising a narrow outer annular rim 108 (narrower than rim or rib 105 of block 46) with a large central recess 110.

The five post block 48 of FIG. 13E is generally L-shaped has five posts 64E and the actuator end of each post has an identical outer rim 108 to the four post block, with a small central projection 112 and an annular groove 114 between projection 112 and rim 108. The six post block 49 of FIG. 13F has a single row of six posts 64F. The actuator formation in the end face of each post 64F has an outer annular rim 105 of identical width to the rim of the posts 64C of the three post block, and has a small central projection 112 of identical size to the central projection of the posts in the five post block, with a smaller annular groove 115 between projection 112 and rim 105.

Seven post block 50 of FIG. 13G is of a perpendicular zig-zag shape and has a series of seven posts 64G. Each post has an actuator formation on its end face comprising a narrow annular outer rim 108 (identical to the rims 108 in the four and five post blocks), an annular groove 116, and a central circular projection 118 of larger diameter than the projections 112 of FIGS. 13E and 13F. FIG. 13H illustrates an eight post block 55 and is on reduced scale from the previous drawings. Eight post block 51 has a series of eight posts 64H which are of the same outer dimensions as the posts in the previously described blocks. The actuator formation on the end of each post comprises a central circular projection 120 with an indented outer annular rim 122 which is of the same width as the annular projection 108 of FIGS. 13D and 13E. The actuator formation on posts 64H is therefore the reverse of the formation on posts 64D of the four post block.

FIG. 13I is also on a reduced scale relative to FIGS. 13A to 13G and illustrates a nine post block 52 in the shape of a cross, having nine posts 64I which again are of the same outer shape and dimensions as the posts of the other blocks, but have a different actuator formation on their outer ends. The actuator formation on each post 64I comprises an outer annular rim or recess 124, followed by a narrow annular rib 125, an annular groove 126, and a small central projection 112 which is of the same dimensions as the central projection 112 of the five and six post blocks.

FIG. 13J illustrates a rectangular, ten post block 53 which has ten posts 64J each having an actuator formation which is the reverse of the actuator formation on the ends of the posts 64E of the five post block. The end of each post 64J has a central indent 102 of the same size as the indent in the single post block 44, followed by an annular rim or rib 128, and an outer, recessed annular rim 124 of the same size as the annular rim of the posts 64I of the nine post block. FIG. 13K illustrates an eleven post block 54 which has eleven posts 64K each having an actuator formation on its end which is the reverse of the actuator formation on the posts 64C of the three post block, comprising a central circular projection or boss 130 surrounded by a recessed annular rim 132 which is wider than the recessed rim 124 of the posts 64J of the ten post block.

FIG. 13L illustrates a rectangular, twelve post block 55 which has ten posts 64L which each have an actuator formation on their end face which is the reverse of the actuator formation on the posts 64G of the seven post block 54. The actuator formation on each post 64L comprises a central circular indent 134, followed by a narrow annular rib or projection 135, and a recessed outer annular rim 124 of the same width as the outer annular rims in the nine and ten post blocks.

In each block, the contoured end faces of the connection devices or posts are of different shapes from the other types of standard block, and the sensor device or switch assembly distinguishes between the different shapes of the end faces, as described in more detail below. In the embodiment of FIGS. 7 to 18, the raised parts of the end face contours are designed to actuate predetermined combinations of the four switches A, B, C, D or E, F, G, H by engaging and pushing on different combinations of push pins or actuators 88. FIG. 17 is a functional block diagram of the electronics unit 70 in a smart block. As illustrated in FIG. 17, the integrated circuit or processor chip 82 is connected to each of the arrays of switches 84 (A to D and E to H) aligned with the ends of each cavity 75, and provides a voice output to speaker 80 depending on the function of the smart block and what combination of switches is actuated.

In one embodiment, different integrated circuits 82 are provided for different types of smart block 40 provided in the building block system. The table below illustrates one example of a building block system having twelve different types of smart block, but different numbers and types of smart block may be provided in alternative embodiments.

TABLE 1

| DESCRIPTION | PROGRAM | TRIGGER |
|---|---|---|
| RED BOARD | 10 RANDOMLY SELECTED OUTPUTS | ANY SWITCH |
| BLUE BOARD | 10 RANDOMLY SELECTED OUTPUTS | ANY SWITCH |
| YELLOW BOARD | 10 RANDOMLY SELECTED OUTPUTS | ANY SWITCH |
| PURPLE BOARD | 10 RANDOMLY SELECTED OUTPUTS | ANY SWITCH |
| ORANGE BOARD | 10 RANDOMLY SELECTED OUTPUTS | ANY SWITCH |
| GREEN BOARD | 10 RANDOMLY SELECTED OUTPUTS | ANY SWITCH |
| PINK BOARD | 10 RANDOMLY SELECTED OUTPUTS | ANY SWITCH |
| ADDITION BOARD | 156 SPEECH OUTPUTS | DETECTED SWITCH COMBINATION (SEE FIG. 18) |
| SUBTRACTION BOARD | 156 SPEECH OUTPUTS | DETECTED SWITCH COMBINATION |

TABLE 1-continued

| DESCRIPTION | PROGRAM | TRIGGER |
|---|---|---|
| DIVISION BOARD | 156 SPEECH OUTPUTS | DETECTED SWITCH COMBINATION |
| MULTIPLICATION BOARD | 156 SPEECH OUTPUTS | DETECTED SWITCH COMBINATION |
| FUN BOARD | 10 RANDOMLY SELECTED OUTPUTS | ANY SWITCH |

In this embodiment, seven different color smart blocks are provided, which have housings which are colored red, blue, yellow, purple, orange, green, and pink. Four different mathematical smart blocks are provided, specifically addition, subtraction, division, and multiplication blocks. A fun block is also provided. Each of the smart blocks is identical to the smart block 40 illustrated in FIGS. 7 to 12, except that they have different colors or indicia depending on their functions, and the electronic unit 70 contains a different board having a differently programmed processor or IC chip 82 depending on the block function, as indicated in the table above. Each of the color blocks has a corresponding color board which has an IC which is programmed to produce an output when any one or more of the switches 84 is triggered. In one embodiment, the output comprises one of ten speech outputs. A greater or lesser number of different outputs may be provided in alternative embodiments. The processing unit may be programmed to select the output randomly, sequentially, or in some other way, each time a switch is triggered. Each output of a color block may state the color of the block and some other phrase of interest, such as "I am blue and I love to build". In alternative embodiments, some of the color block output statements do not include the color of the block. The different output statements help to retain the child's interest. In other alternative embodiments, some or all of the outputs may comprise other types of audible outputs (music, buzzers, or other types of noise) or may comprise other types of sensory signal such as visual outputs.

Each of the four math blocks contains a corresponding math board, e.g. an addition board, a subtraction board, a division board, or a multiplication board having an integrated circuit or IC which is programmed to perform the designated function based on the detected combination of switches triggered, as explained below in connection with FIGS. 13, 14, and 18. In one embodiment, the fun block contains a fun board carrying an IC programmed to produce different, randomly selected outputs when any switch is triggered. The fun block may be designed to produce outputs sequentially or in some other manner, The outputs may be any type of sensory output signal such as audible, visual, or combinations of audible and visual outputs, as described in more detail below in connection with FIG. 19.

The duration of the audible output signal produced by any smart block, the content of the audible output signal, and the number of different audible output signals provided on any smart block board, may be varied as desired for different embodiments of the building block system or for different smart blocks provided in the same system. In one embodiment, output signals of approximately six seconds in length are produced, but signals of a greater or shorter duration may be provided in alternative embodiments, and different outputs from the same block may be of varying duration. The output signals may be visual rather than audible in other embodiments, or may be combinations of audible and visual output signals, with inclusion of appropriate visual output devices on the respective smart blocks. In the case of the math blocks, an output screen may be provided on the block which displays the answer to the math problem, rather than a spoken output as described above.

The various blocks can be secured together in any desired combination by a child playing with the blocks. Since the mating formations or ribs 76 in recesses or cavities 75 are designed to mate with conventional, known building blocks, such as Lego® blocks, the kit can be combined with such conventional building block sets as desired. FIGS. 9 and 11 illustrate a construction example in which a smart block 40 is connected to a single post non-smart or standard block 44 of the kit and a Lego® block 140, with the post 64A of the block 44 in mating engagement with one of the cavities 75 and the posts 142 of the conventional Lego® building block 140 engaging in the other cavity 75. When the post 64A of the block 44 is fully engaged in the first recess 75, the actuator formation at the end of the post 64A pushes three of the actuator push pins (pins E, F, and G) of the second switch array to turn on the aligned push button switches. If the smart block 40 is one of the color blocks or the fun block, this results in generation of an audible output comprising one of the programmed statements stored in the memory of processing unit 82 (see table above and FIG. 17). In the case of the color smart blocks, the statement includes identification of the color of the block. If the smart block 40 is a mathematical function block, the output statement is 1+0=1, as explained in more detail below.

Figure 14:
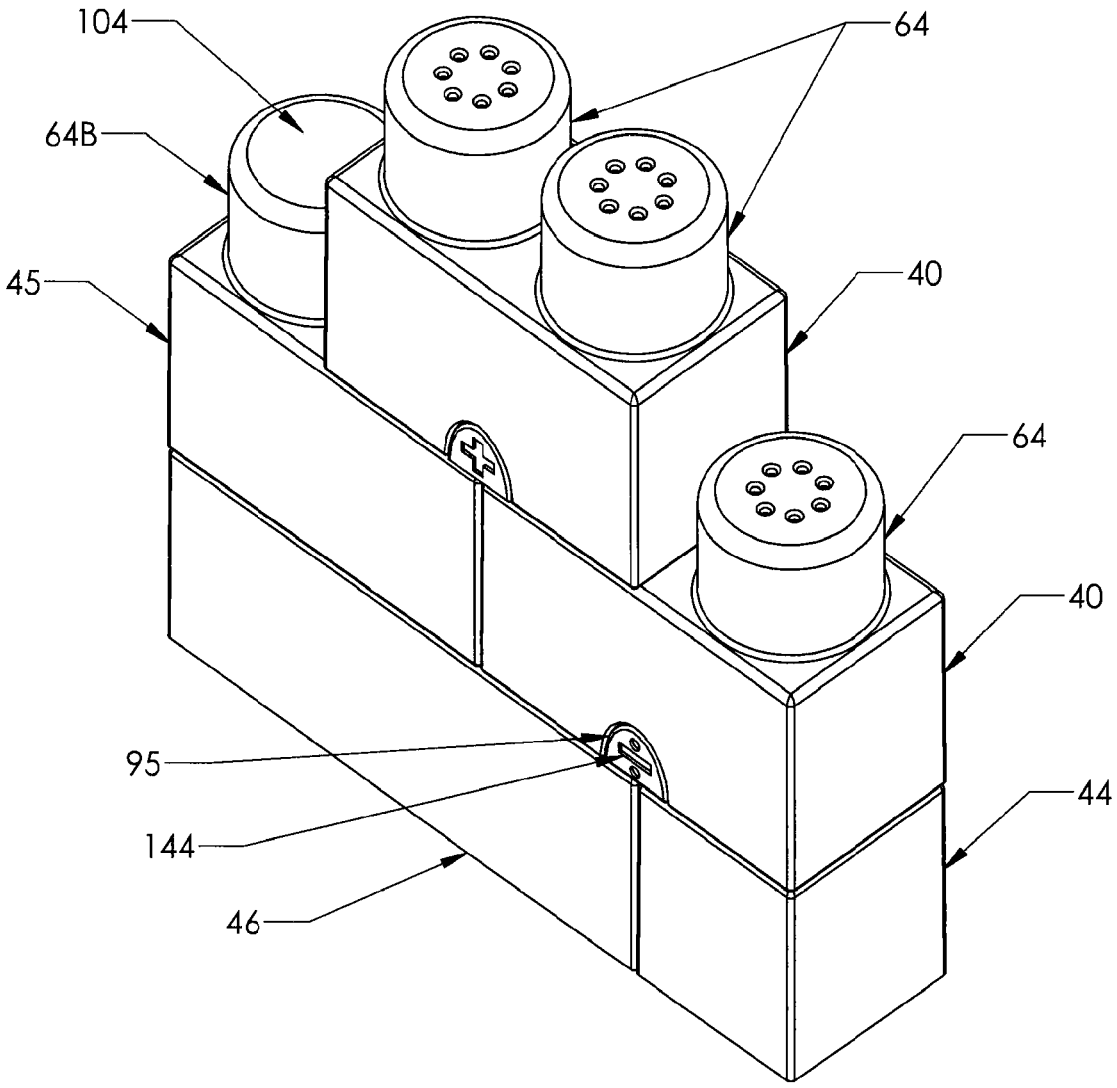
FIG. 14 is a perspective view illustrating an addition smart block secured on top of a division smart block and a standard block which are secured on top of a single and triple post block of the building block set of FIGS. 7 to 13.
Figure 15:
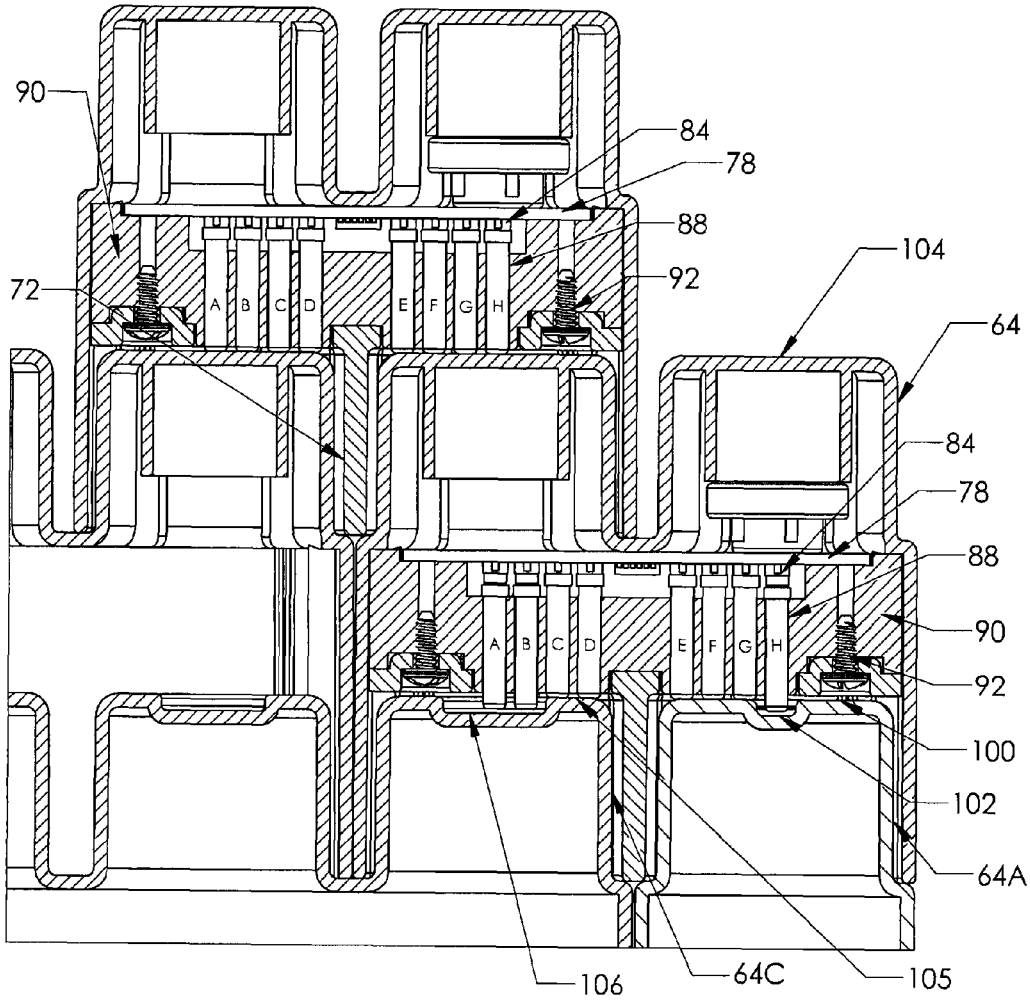
FIG. 15 is a sectional view through the connected blocks of FIG. 14 illustrating the switch pin actuation.
Figure 16:
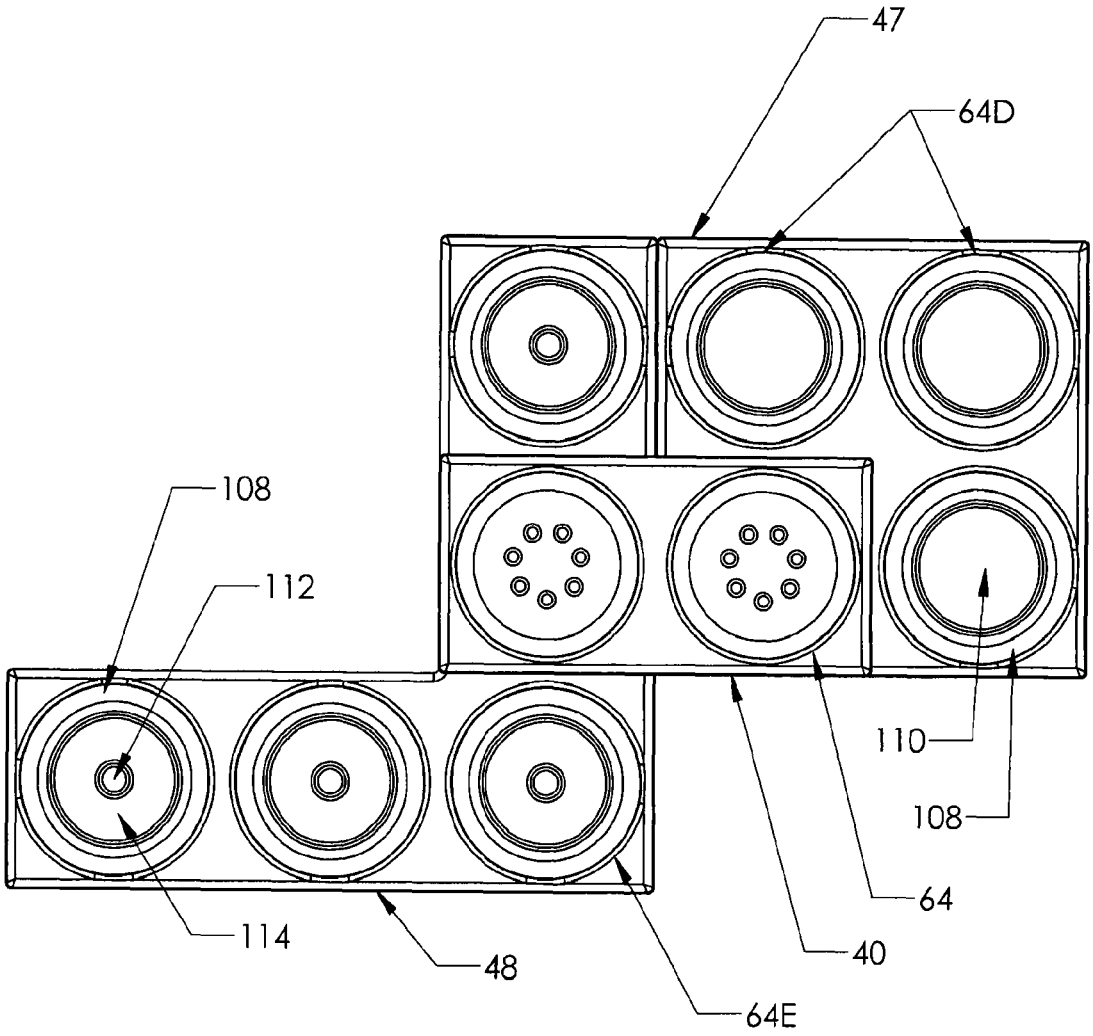
FIG. 16 is a top plan view illustrating a smart block attached to two different standard blocks of the building block set of FIGS. 7 to 13.
Figure 17:
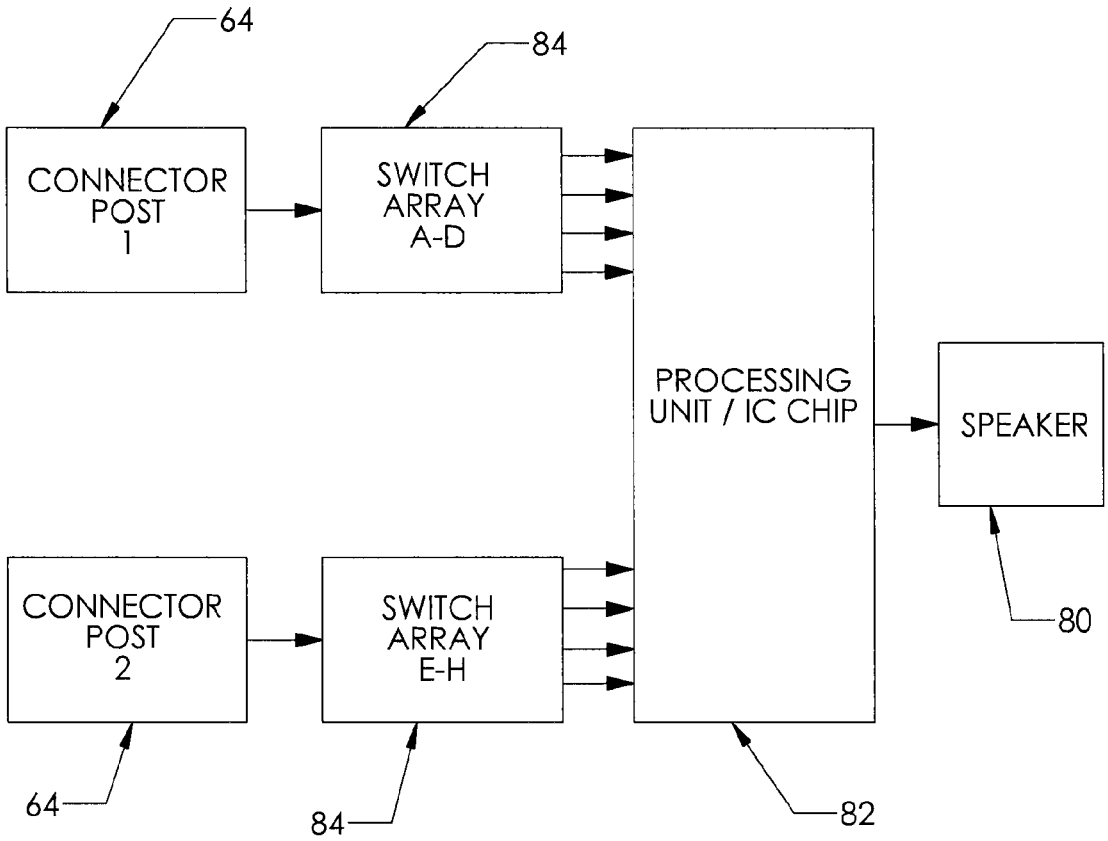
FIG. 17 is a block diagram illustrating the electronic control circuit in one of the smart blocks of FIGS. 7 to 12.

FIGS. 14, 15, and 16 illustrate examples of the attachment of smart blocks 40 to different combinations of standard blocks. In FIGS. 14 and 15, a first smart block 40 (in this case a division block with a division sign 144 on end plates 95) is engaged with a single post block 44 and one of the posts of a triple post block 46. As illustrated in FIG. 14, the post 64C of the triple post block engages in the first cavity 75 and the outer annular rim 105 on the end of post 64C engages and pushes up two of the actuator push pins 88 projecting into the cavity, turning on switches C and D. The post 64A of the single post block 44 enters the second cavity 75 and the wider annular rim 100 on that post pushes up three of the push pins 88 projecting into that cavity, turning on the switches E, F, and G. Referring to FIG. 17, the switch combination C, D and E, F, G is identified by the division processor as corresponding to the numbers three and one, and produces a voice output stating "One divided by three equals one third." A two post standard block 45 is attached on top of the remaining two posts 64C of the triple post block 46.

A second smart block 40 is attached at the top of the structure in FIGS. 14 and 15, with the first cavity 75 engaging over a post 64B of the standard two post block, and the second cavity 75 engaging over the adjacent post 64 of the division smart block 40. In this case, the uppermost smart block 40 is an addition block with a plus sign 98 on end plates 95. As noted above, the smart blocks 40 are all identical in external shape and dimensions to the two post standard block 45. The end faces 104 of posts 64 and 64B which engage in the two cavities 75 are completely flat, and engage and push up all of the push pins 88 in each cavity, turning on all of the switches 84 (A, B, C, D, E, F, G, and H), as seen in FIG. 15. Referring again to FIG. 17, the addition processor 82 responds to this input from the two arrays of switches with the statement, "Two plus two equals four".

FIG. 16 illustrates another construction in which a smart block 40 is engaged over one post 64D of a four post block 47 and one post 64E of a five post block 48. Due to the different actuator formations on the ends of posts 64D and 64E, different combinations of switches in each cavity 75 are actuated. The posts 64D of the four post block each have a narrow outer rim 108 which engages and pushes on the outermost actuator push pin 88 in each cavity and thus turns on either switch D or switch E, depending on the cavity in which it is engaged, and no other switch is turned on in view of the large central depression 110. The posts 64E of the five post block have an actuator formation which is the same as the four post block except for the central small projection 112. These actuator formations therefore turn on the outermost and innermost switch of the cavity in which a post is engaged, i.e. either switch A and D or switch E and H. Assuming that post 64E engages the first cavity and post 64D engages the second cavity, the processor 82 on the smart block addition board detects turning on of switches A and D and switch E, and produces the voice output: "Five plus four equals nine". If it was the other way around, and the detected switch combination was switch D in the first array and switches E and H in the second array, the processor 82 produces the voice output, "Four plus five equals nine". If the board is a multiplication board, the output produced is "Four times five equals twenty".

The building block set of FIGS. 7 to 18 is extremely versatile and can be used in many different ways to produce different voice outputs. FIG. 18 illustrates the different outputs produced by an addition smart block when connected to posts of different combinations of the standard number blocks of FIGS. 13A to 13L. The post 64A of the single post block actuates either switches BCD or switches EFG, depending on the cavity in which it is engaged, designating the number one to the mathematical processor of any of the math smart blocks. Post 64B of the two post block or post 64 of any smart block actuates all of the switches in the cavity in which it engages, i.e. either switches ABCD or switches EFGH, and designates the number two. The annular rim 105 of post 64C is designed to actuate switches CD or EF, designating the number three. The narrower annular rim 108 of post 64D of the four post block actuates only one switch in the cavity in which it engages, either switch D or switch E, designating the number four. The other actuator formations on blocks five through twelve result in actuation of the various other switch combinations indicated in FIG. 18. Although FIG. 18 illustrates the outputs of an addition smart block, the other math blocks are programmed to produce the appropriate output based on the detected combinations of posts. For example, if the smart block is a subtraction smart block, detection of a post 64J of the ten post block in a first cavity (actuation of switches BC by annular rib 128) and post 64I of the nine post block in a second cavity (actuation of switches FH by rib 125 and center post 112), the output "Ten minus nine equals one" is produced. If the smart block is a multiplication block, the output "Ten times nine equals ninety" is produced.

FIGS. 13A to 13L illustrate just one possible example of a combination of twelve different actuator formations to represent the numbers one through twelve. Different actuator formations may be used for the number blocks in alternative embodiments, with suitable programming of the corresponding math processors to identify the correct number based on the switches actuated. For example, the one post block may alternatively have any of the formations on the other eleven blocks instead of the formation illustrated in FIG. 13A. All that is necessary is that the formations are arranged to actuate different switch combinations for each of the different number blocks.

Similarly, although the smart blocks in the embodiment of Table 1 above comprise seven different color smart blocks, four different math smart blocks, and one fun smart block, additional or alternative smart blocks may be provided in alternative embodiments. For example, musical notes may be provided as an output from a smart block with appropriate indicia on the outer surface of the block. Other smart blocks may carry indicia representing different musical instruments, with the associated processor on the board producing an output corresponding to the sound made by that instrument. Although the color blocks and fun block in Table 1 are programmed to produce ten different randomly selected voice or speech outputs, a greater or lesser number of different outputs may be provided in alternative embodiments.

Figure 19:
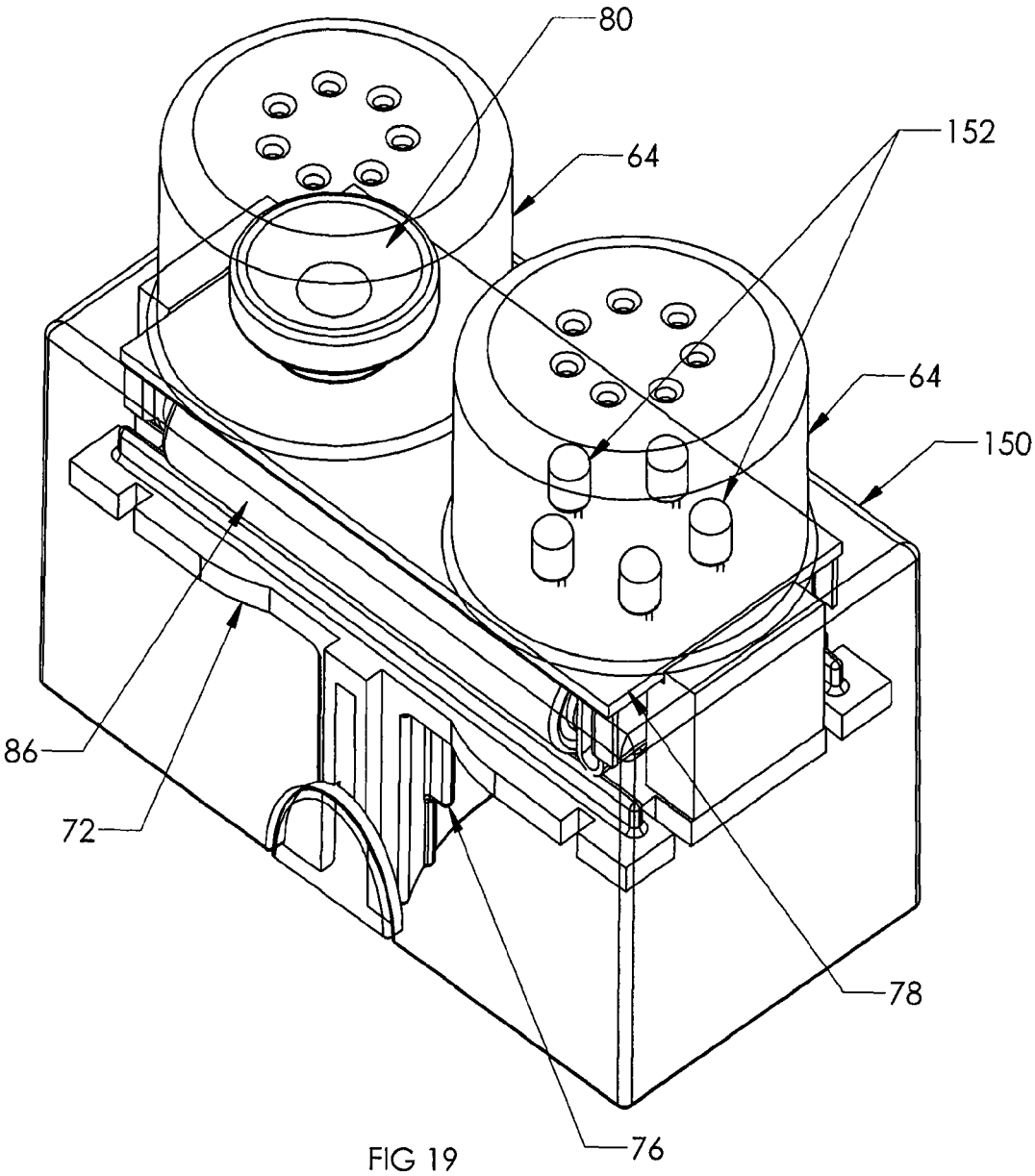
FIG. 19 is a perspective view of a modified smart block for producing both audible and visual outputs.

In the foregoing embodiments, the smart block outputs are all audible outputs via a speaker. FIG. 19 illustrates an alternative smart block 150 which may be used with the building block kit of FIGS. 7 to 18 and which produces both an audible output and a visual output when activated. Some parts of the smart block 150 are identical to those of smart block 40 of the previous embodiment, and like reference numbers are used for like parts as appropriate. Block 150 is made wholly of transparent material in the illustrated embodiment, although just the posts 64 may be transparent in alternative embodiments. Smart block 150 is identical in external shape and internal components to the two post smart block 40 of FIGS. 7 to 17, apart from the addition of an array of light emitting diodes (LEDs) 152 on circuit board 78, and modification of processing unit 82 to control operation of LEDs 152 in addition to the output of speaker 80. LEDs 152 are mounted on the same side of circuit board 78 as the speaker 80, with the speaker 80 located under one post 64 and the LEDs 152 located under the other post. In an alternative embodiment, LEDs may be located under both posts or elsewhere, and the speaker 80 may be eliminated to provide a smart block having a visual output only. The LEDs may be mounted externally on the smart block housing in another embodiment, and in this alternative the housing need not be transparent.

Block 150 may have a series of different possible outputs include an audible signal only, a visual signal only, and a combination of both audible and visual signals, such as a siren and flashing lights, or flashing lights along with musical notes, for example. Block 150 may be the fun block of Table 1 (above) in the system of FIGS. 7 to 18, with the outputs including both audible and visual components.

The building block kit of the above embodiments may be provided in stages as a child grows older. For an infant, a basic set comprising only the smaller standard blocks, such as blocks one to four, may be purchased. For a toddler, color and fun smart blocks may be purchased and used with the basic standard block set. The child can play with these blocks and receive various different output messages or signals from each of the smart blocks, as indicated in Table 1 above. As a child grows, additional standard blocks can be purchased, such as blocks five through twelve, and finally a set of math blocks may be purchased.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A building block toy set, comprising:

a plurality of interconnectable toy blocks comprising at least one smart block and a plurality of standard blocks, each having at least one first connection device at one end and at least one second connection device at an opposite end, one of the connection devices comprising a male connection device and the other connection device comprising a female connection device, whereby at least two of the plurality of interconnectable toy blocks can be interconnected by mating the first connection device of either block with the second connection device of the other block;

the smart block having a sensor device associated with a the first connection device and configured to be actuated by connection of the first connection device with a mating second connection device on a standard block, and a processing unit associated with the sensor device which produces a sensory output signal at the smart block in response to actuation of the sensor device;

the standard blocks comprising at least first and second standard blocks each having a contoured end face on the second connection device, the end face of the second connection device of the first standard block having a contour of a shape different from the contour on the end face of the second connection device of the second standard block; and the sensor device being configured to distinguish between the different shapes of the contoured end faces of the second connection devices of the first and second standard blocks when the first connection device of the smart block is engaged by the second connection device of the first and second smart block, respectively, and to provide a first sensor input to the processing unit when actuated by connection of the smart block to the first standard block and a second different sensor input to the processing unit when actuated by connection of the smart block to the second standard block.

2. The building block toy set of claim 1, wherein the sensory output signal is selected from the group consisting of audible output signals, visual output signals, and combinations of audible and visual output signals.

3. The building block toy set of claim 2, wherein at least some of the sensory output signals comprise visual output signals, and the smart block has at least one light source controlled by the processing unit to produce a visual output signal.

4. The building block toy set of claim 1, wherein the smart block has two first connection devices and a respective sensor device is associated with each first connection device, whereby two standard blocks having second connection devices can be connected simultaneously to the smart block.

5. The building block toy set of claim 4, wherein the processing unit comprises a processing module configured to distinguish between actuation of one of the sensor devices when the smart block is connected to one standard block in a first configuration and actuation of both sensor devices when the smart block is connected to two standard blocks in a second configuration, and the processing unit includes a sensory output module which is configured to produce different sensory output signals for the first and second configurations.

6. The building block set of claim 1, wherein the male connection device of each toy block comprises a post and the female connection device of each toy block comprises a cavity of predetermined shape and dimensions for mating engagement with the post.

7. The building block set of claim 1, wherein the female connection device has interengageable formations which are selectively connectable with connector devices of a different type of building block.

8. The building block set of claim 1, comprising a plurality of smart blocks, the processing units of at least some of the smart blocks being configured to produce different sensory output signals from other smart blocks when connected to the same standard block.

9. The building block toy set of claim 8, wherein the smart blocks include different color blocks, each color block having a processing unit programmed with sensory output signals comprising a plurality of different audible outputs, at least some of the audible outputs including the color of the block, the processing unit producing an audible output selected from said different audible outputs when the first connector device is connected to the second connector device of any other block in the set.

10. The building block toy set of claim 1, wherein the processing unit of the smart block is programmed with at least first and second different sensory output signals, the processing unit being configured to produce the first sensory output signal when the smart block is connected to the first standard block and the second sensory output signal when the smart block is connected to the second standard block.

11. The building block toy set of claim 1, wherein the standard blocks comprise a plurality of different size standard blocks.

12. The building block set of claim 1, wherein the sensor device comprises an array of switches associated with the respective first connection device and connected to the processing unit, the different shapes of the contoured end faces of the respective different standard blocks actuating different switches of the array when the respective second connection devices are engaged with the first connection device of the smart block.

13. The building block set of claim 12, wherein the processing unit of includes a processing module which is configured to detect sensor input signals which vary based on the switches actuated in each array, and which produces an output signal comprising a different sensory output based on the detected combination of actuated switches in each array.

14. The building block set of claim 13, wherein the processing unit of a second smart block includes a processing module which produces an output signal comprising at least one sensory output when one or more switches in the array are actuated by an actuator formation of any other block, the output signal being independent from the detected actuator formation.

15. The building block set of claim 1, wherein the plurality of standard blocks comprise at least a set of number blocks representing a plurality of different numbers, each block having a predetermined number of second connection devices equal to the number represented by the block, which is which each having a contoured end face of the same shape as contoured end faces on other second connection devices on the block and of different shape from the contoured end facess on the second connection devices of all of the other different number blocks.

16. The building block set of claim 15, wherein said smart block comprises a math block for carrying out a predetermined mathematical function, the math block having at least two first connection devices each associated with a respective sensor device, the processing unit of the math block detecting sensor inputs from the sensor devices associated with each first connection device which are actuated by the contoured end faces on the second connection devices of one or more number blocks to which the math block is connected, determining the number associated with a connected block based on the detected sensor inputs to the processor unit, carrying out the predetermined mathematical function using the determined numbers, and producing an audible output statement comprising the answer to the mathematical function.

17. The building block set of claim 16, further comprising a plurality of math blocks which perform different mathematical functions.

18. The building block set of claim 17, wherein the math blocks each have at least one symbol on their outer surface indicating the function performed by the respective block.

19. The system of claim 1, wherein the processing unit includes a sensory output module configured with a plurality of different audible output signals and a processing module configured to control the sensory output module to emit a selected audible output signals on actuation of the sensor device.

20. The system of claim 19, wherein the selected audible output signal is randomly selected from the plurality of different audible output signals.

21. The system of claim 19, wherein the processing module is configured to control the sensory output module to emit a predetermined audible output signal corresponding to the detected shape of the contoured end face of the second connection device of an attached standard block and a different audible output signal is emitted when the smart block is connected to the first standard block and the second standard block.

22. The system of claim 21, further comprising a set of standard, non-smart building blocks including the first and second standard blocks and a plurality of additional standard blocks, the contoured end face of each second connection device of a respective standard block having a different shape from the contoured end faces of the second connection devices of at least some of the other standard blocks in the set, the sensor device being configured to produce a different output on detection of each of the different contoured end face shapes, and the processing module being configured to distinguish between the different standard blocks based on the detected sensor output and to control the sensory output module to emit a different predetermined audible output signal dependent on the standard block to which the smart block is connected.

23. The system of claim 19, wherein the different audible output signals comprise speech output signals.

24. The system of claim 19, wherein the different audible output signals comprise music.

25. A building block toy set, comprising:

at least one smart block having at least one first connection device, a first sensor device associated with the first connection device, a processing unit connected to the sensor device and having a processing module which detects actuation of the sensor device, and at least one audible output module connected to the processing module which produces an audible output signal when the first sensor device is actuated;

at least first and second standard, non-smart blocks each having at least one second connection device which is releasably connectable to the first connection device of the smart block, the first and second connection devices being configured to releasably connect the smart block to the respective standard block; and each second connection device having a contoured end face of predetermined shape configured to actuate the sensor device when the second connection device is in releasable mating engagement with the first connection device, the contoured end face of the second connection device of the first standard block having a different shape from the contoured end face of the second connection device of the second standard block;

the first sensor device being configured to discriminate between the different shapes of the end faces of the second connection devices of the first and second standard blocks and to produce different sensor outputs when the smart block is connected to the first and second standard blocks, respectively; and the output module is configured to produce a different audible output signal in response to the different sensor outputs when the first connection device is in releasable mating engagement with the second connection devices of the first and second standard block, respectively.

26. The system of claim 25, further comprising a visual output device connected to said processing module to produce visual output signals.

27. The system of claim 26, wherein the visual output device comprises an array of light emitting devices and the processing module controls the light emitting devices to produce a selected visual output signal from a plurality of different visual output signals.

* * * * *